US008418494B2

(12) United States Patent
Shinozaki et al.

(10) Patent No.: US 8,418,494 B2
(45) Date of Patent: Apr. 16, 2013

(54) AIR CONDITIONING APPARATUS

(75) Inventors: Kazuyoshi Shinozaki, Tokyo (JP); Tomoki Inagaki, Tokyo (JP); Tatsuo Ono, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 393 days.

(21) Appl. No.: 12/676,177

(22) PCT Filed: Sep. 26, 2007

(86) PCT No.: PCT/JP2007/068606

§ 371 (c)(1),
(2), (4) Date: Mar. 3, 2010

(87) PCT Pub. No.: WO2009/040889

PCT Pub. Date: Apr. 2, 2009

(65) Prior Publication Data

US 2010/0199695 A1 Aug. 12, 2010

(51) Int. Cl.
*F25B 13/00* (2006.01)

(52) U.S. Cl.
USPC ..... 62/324.1; 62/525

(58) Field of Classification Search ..... 62/324.1, 62/238.7, 510, 504, 525
See application file for complete search history.

(56) References Cited

U.S. PATENT DOCUMENTS

| | | | |
|---|---|---|---|
| 5,156,014 | A | 10/1992 | Nakamura et al. |
| 5,279,131 | A | 1/1994 | Urushihata et al. |

FOREIGN PATENT DOCUMENTS

| | | | |
|---|---|---|---|
| AU | 74381/91 | B | 10/1991 |
| GB | 2 248 494 | A | 4/1992 |
| JP | 0 453 271 | A2 | 10/1991 |
| JP | 4-093561 | A | 3/1992 |
| JP | 7-052045 | B2 | 6/1995 |
| JP | 9-101070 | A | 4/1997 |

OTHER PUBLICATIONS

Japanese Office Action (Notification of Reasons for Refusal) dated Mar. 21, 2012, issued in the corresponding Japanese Patent Application No. 2009-534080, and a English Translation thereof. (3 pages).
International Search Report of PCT/JP2007/068606 dated Jan. 8, 2008.
Office Action from Chinese Patent Office issued in corresponding Chinese Patent Application No. 200780100841.8 dated Mar. 30, 2011.
Office Action (Decision of Rejection) issued by the Japanese Patent Office on Dec. 25, 2012 in corresponding Japanese Patent Application No. 2009-534080, and an English translation thereof.

*Primary Examiner* — Mohammad Ali
(74) *Attorney, Agent, or Firm* — Buchanan Ingersoll & Rooney PC

(57) ABSTRACT

An air conditioning apparatus includes a plurality of heat source apparatuses having heat source apparatus side heat exchangers and compressors, one or a plurality of indoor units having flow rate control devices and indoor unit side heat exchangers, at least two main pipes for performing connection-piping between a plurality of heat source apparatuses and one or a plurality of indoor units, a tubular distributor for branching the refrigerant from the main pipe flowing from the inlet to a plurality of outlets to distribute into a plurality of heat source apparatuses, and connection piping for connecting the plurality of heat source apparatuses and distributor respectively. Among a plurality of heat source apparatuses, the distributor is fixedly disposed at a specified position and in a specified direction against one heat source apparatus.

14 Claims, 11 Drawing Sheets

AIR CONDITIONING APPARATUS

TECHNICAL FIELD

The present invention relates to an air conditioning apparatus using a refrigeration cycle, more particularly to an arrangement of a distributor and the like installed for distributing refrigerant and refrigerator oil when a plurality of heat source apparatuses (heat source side units) are provided.

BACKGROUND ART

An air conditioning apparatus is provided that can individually arbitrarily perform cooling and heating operations. (For example, refer to Patent Document 1) In such an air conditioning apparatus, a refrigerant flows in the same direction in a plurality of refrigerant piping from a heat source apparatus to a plurality of indoor units (load side units). That is, a high-pressure refrigerant is output from the heat source apparatus and a low-pressure refrigerant returns to the heat source apparatus. Thereby, there is one heat source apparatus and since the refrigerant returns to the heat source apparatus always through a single piping from a plurality of indoor units, the refrigerant returns to the heat source apparatus in the proper quantity. In addition, hereinafter high or low pressure is not specified in relation to a reference pressure but represented as a relative pressure by such as pressurization by a compressor 11 and a refrigerator pass control by each throttle device. Further, it is the same for high and low temperatures.

The refrigerant oil discharged from the compressor in the heat source apparatus returns through the indoor unit to the heat source apparatus, however, since such refrigerator oil all returns to a single heat source apparatus, problems such as a depletion of the refrigerator oil hardly occur.

[Patent Document 1] Japanese Examined Patent Application No. H7-52045

DISCLOSURE OF INVENTION

Problems to be Solved by the Invention

For example, when there are many indoor units and much more capability is required for the heat source apparatus side, air conditioning is performed by pipe-connecting a plurality of heat source apparatuses. Thereby, for example, a plurality of heat source apparatuses are connected in parallel, the refrigerant in each heat source apparatus is joined to be supplied to the indoor unit side, and the refrigerant and refrigerator oil from the indoor unit side are branched to be distributed to each heat source apparatus. Then, it is necessary to distribute them to each heat source apparatus with an appropriate amount in accordance with an operation condition thereof.

In the case when the refrigerant is in a gas-liquid two-phase condition and the refrigerator oil is mixed and included in a gas refrigerant, a liquid refrigerant and refrigerator oil are not necessarily divided according to the same ratio as a distribution ratio of the gas refrigerant. Especially under such a condition that a gas flow rate falls, a liquid becomes a laminar flow to flow along an inner surface of piping and be subjected to gravity and centrifugal forces. Therefore, it is not easy to determine the degree of distribution of liquids. When a liquid distribution rate changes dependent on such as an installation status of distribution means and the like, it is possible that some heat source apparatuses may run short of the refrigerant and return amount of the refrigerator oil. Nevertheless, installation of distribution means has been subjected to, for example, convenience of arrangement of a plurality of heat source apparatuses at an installation site.

In order to solve the above problems, the purpose of the present invention is to provide an air conditioning apparatus capable of effectively distributing the refrigerant and refrigerator oil into a plurality of heat source apparatuses.

Means for Solving the Problems

An air conditioning apparatus according to the present invention includes a plurality of heat source apparatuses having a heat source apparatus side heat exchanger and a compressor, one or more indoor units having a flow rate control device and an indoor unit side heat exchanger, at least two main pipes for pipe-connecting between a plurality of heat source apparatuses and one or more indoor units, a tubular distributor for branching a refrigerant from a main pipe flowing from an inlet into a plurality of outlets to distribute into a plurality of heat source apparatuses, and connection piping for connecting a plurality of heat source apparatuses and the distributor respectively and fixedly disposes the distributor against one heat source apparatus among the plurality of heat source apparatuses at a predetermined position in a predetermined direction.

Effect of the Invention

According to the present invention, since a distributor for distributing a refrigerant to a plurality of heat source apparatuses is fixedly disposed at a predetermined position against one heat source apparatus, a stable refrigerant distribution can be performed according to a predetermined supposed distribution by the arrangement in consideration of the effect of gravity and each heat source apparatus (especially one heat source apparatus).

REFERENCE NUMERALS

Figure 1:
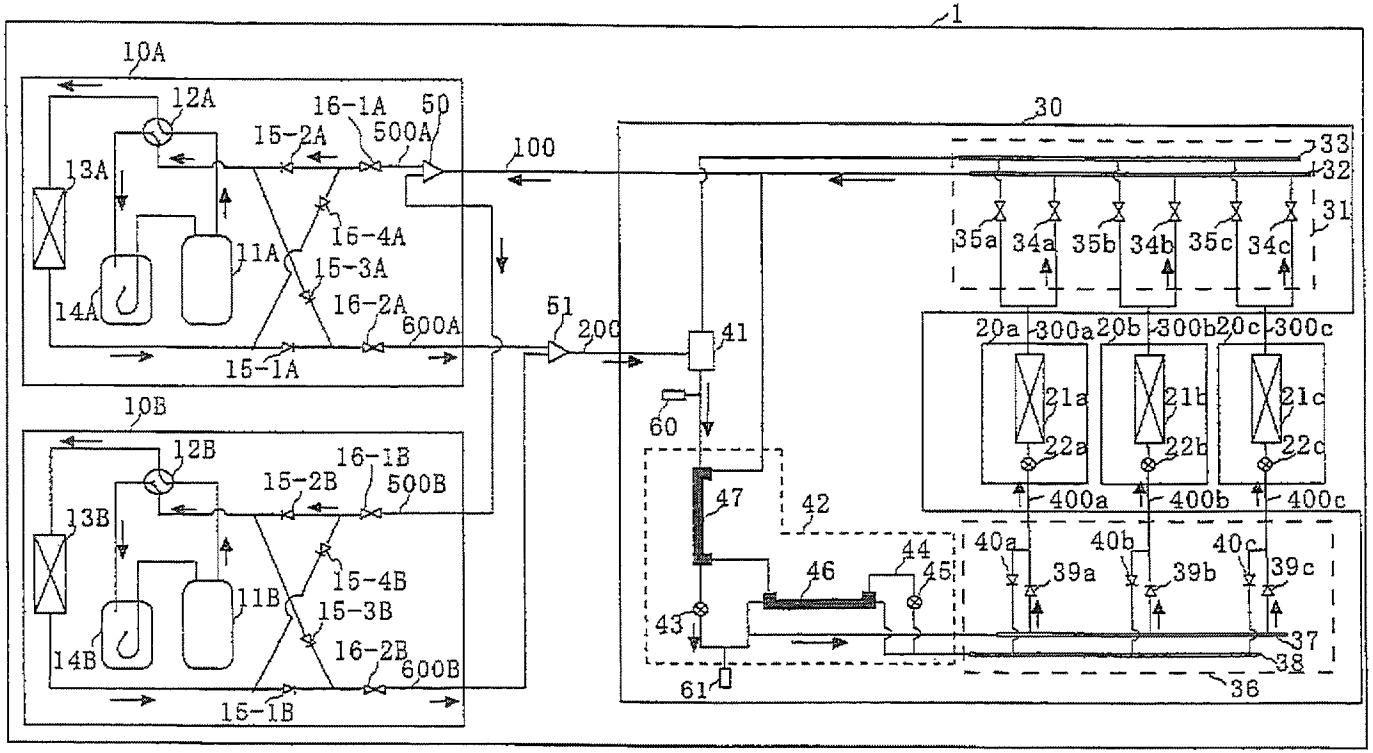
FIG. 1 is a diagram showing an entire configuration and the like of an air conditioning apparatus 1 according to Embodiment 1.

1 air conditioning apparatus
10A, 10B heat source apparatus

11A, 11B compressor
12A, 12B four-way switching valve
13A, 13B heat source apparatus side heat exchanger
14A, 14B accumulator
15-1A, 15-1B first check valve
15-2A, 15-2B second check valve
15-3A, 15-3B third check valve
15-4A, 15-4B fourth check valve
16-1A, 16-1B first manual opening and closing valve
16-2A, 16-2B second manual opening and closing valve
16-3A, 16-3B third manual opening and closing valve
17A, 17B fixing sheet metal
18A, 18B electromagnetic opening and dosing valve
19A, 19B flow rate control valve
20*a*, 20*b*, 20*c* indoor unit
21*a*, 21*b*, 21*c* indoor unit side heat exchanger
22*a*, 22*b*, 22*c* indoor unit side flow rate control device
30 relay
31 first branched part
32, 33 association part
34*a*, 34*b*, 34*c* first opening and closing valve
35*a*, 35*b*, 35*c* second opening and closing valve
36 second branched part
37, 38 association part
39*a*, 39*b*, 39*c* first relay check valve
40*a*, 40*b*, 40*c* second relay check valve
41 gas-liquid separator
42 relay supercooled portion
43 first flow rate control device
44 bypass piping
45 second flow rate control device
46 first heat exchange part
47 second heat exchange part
50 distributor
51 merger
52 distribution merger
60 first pressure detector
61 second pressure detector
100 first main pipe
200 second main pipe
300*a*, 300*b*, 300*c* first branched pipe
400*a*, 400*b*, 400*c* second branched pipe
500A, 500B first connection piping
600A, 600B second connection piping
700A, 700B branched pipe
800A, 800B third connection piping
900 main high-pressure gas pipe

BEST MODE FOR CARRYING OUT THE INVENTION

Embodiment 1

FIG. 1 is a diagram showing an entire configuration and the like of an air conditioning apparatus according to Embodiment 1. Firstly, descriptions will be given to means (a device) and the like constituting an air conditioning apparatus 1 based on FIG. 1. The air conditioning apparatus 1 performs cooling and heating operations using a refrigeration cycle (heat pump cycle) by a refrigerant circulation. Especially, the air conditioning apparatus 1 is provided that it is a device capable of performing a cooling-heating mixed operation that simultaneously performs the cooling and heating operations in a plurality of indoor units.

As shown in FIG. 1, the air conditioning apparatus 1 of the present embodiment is mainly composed of a plurality of heat source apparatuses (heat source side unit, outdoor unit) 10A and 10B, a plurality of indoor units (load side units) 20*a*, 20*b*, and 20*c*, and a relay 30. In order to control the refrigerant flow, a relay 30 is provided between heat source apparatuses 10A and 10B and indoor units 20*a*, 20*b*, and 20*c* to be pipe-connected by various refrigerant piping. A plurality of indoor units (load side units) 20, 20*b*, and 20*c* are connected so as to be arranged in parallel. In addition, when not be distinguished in particular, refrigerator oil in the refrigerant will be also included in the refrigerant in the explanations as follows. Also, for example, when heat source apparatuses 10A and 10B and the like are not distinguished or identified in particular, suffixes such as A and B will be abbreviated in the description hereinafter.

Between the heat source apparatus 10A and the relay 30 connect a set of a first main pipe 100, a distributor 50, and a first connection piping 500A and the set of a second main pipe 200, a merger 51, and a second connection piping 600A. In the same way, between the heat source apparatus 10B and the relay 30 connect a set of the first main pipe 100, the distributor 50, and the first connection piping 500B and the set of the second main pipe 200, the merger 51, and the second connection piping 600B. Then, in the set of the first main pipe 100, distributor 50, and first connection piping 500, a low-pressure refrigerant flows from the relay 30 side to the heat source apparatus 10 side. In the set of the second main pipe 200, the merger 51, and the second connection piping 600, a high-pressure refrigerant flows from the heat source apparatus 10 side to the relay 30 side.

Here, in the present embodiment, for example, it is provided that the distributor 50 is installed inside the heat source apparatus 10A, that is tubular distribution means having one inlet and a plurality of outlets. Because of this, the first connection piping 500A is inside the heat source apparatus A. The relation among the distributor 50, the first connection piping 500A, and the heat source apparatus A will be described later. On the other hand, as for the tubular merger 51 having a plurality of inlets and one outlet, the installation varies according to where heat source apparatuses 10A and 10B are installed. Therefore, basically, the merger 51 is installed outside the heat source apparatus 10 and the refrigerant flowing in the second connection piping 600A and 600B are made to be joined to flow into the second main pipe 200. Here, in the air conditioning apparatus according to the present embodiment, a diameter of the first main pipe 100 is larger than that of the second main pipe 200.

On the other hand, the relay 30 and the indoor unit 20*a* are connected by the second branched pipe 400*a* and the first branched pipe 300*a*. In the same way, the relay 30 and indoor unit 20*b* are connected by the second branched pipe 400*b* and the first branched pipe 300*b*, and the relay 30 and indoor unit C are connected by the second branched pipe 400*c* and the first branched pipe 300*c*. Through a piping connection by the first main pipe 100, second main pipe 200, second branched pipe 400 (400*a*, 400*b*, and 400*c*) and first branched pipe 300 (300*a*, 300*b*, and 300*c*), the refrigerant circulates among the heat source apparatuses 10A and 10B, relay 30, indoor unit 20*a*, 20*b*, and 20*c* to configure a refrigerant circuit.

In FIG. 1, the heat source apparatus 10 (10A and 10B) is configured by each component as mentioned below. Here, the heat source apparatuses 10A and 10B have almost the same configuration, so that descriptions will be given to the heat source apparatus 10A. The compressor 11 (11A and 11B) pressurizes the sucked refrigerant to discharge it (send it out). It is not limited in particular but the compressor 11 according to the present embodiment is a capacity-variable inverter compressor implementing an inverter circuit (not shown). Therefore, for example, by freely changing a drive frequencies, which are larger than a minimum drive frequency, a capacity (refrigerant discharge amount per unit time) and cooling and heating capability (heat quantity per hour applied to the indoor unit side. Hereinafter, called as capability) accompanied thereby can be changed. A four-way switching valve 12 (12A and 12B) is made to switch a refrigerant path by switching valves in accordance with the operation. In the present embodiment, path is made to be switched according to a all cooling operation (here, all indoor units under operation perform cooling operation), cooling-dominant operation (cooling operation becomes dominant in the cooling-heating mixed operation), and all heating operation (here, all indoor units in operation perform heating operation), heating-dominant operation (heating operation becomes dominant in the cooling-heating mixed operation).

A heat source apparatus side heat exchanger 13 (13A and 13B) has, for example, a pipe for passing the refrigerant and a fin for increasing a heat transfer area of the refrigerant passing the pipe and the air (outdoor air) to perform heat exchange between the refrigerant and the air. For example, at the time of heating and heating-dominant operations, the heat source apparatus side heat exchanger 13 functions as an evaporator to evaporate the refrigerant into a gas. On the contrary, when in the cooling and cooling-dominant operations, the heat exchanger 13 functions as a condenser to condense the refrigerant into a liquid. For example, at the time of the cooling-dominant operation, the heat exchanger 13 is adjusted to condense the refrigerant up to a state of a two-phase region (gas liquid two-phase refrigerant) of a liquid and a gas. In the neighborhood of the heat source apparatus side heat exchanger 15, a heat source apparatus side fan (not shown) is provided for efficiently performing heat exchange between the refrigerant and the air. An accumulator 14 (14A and 14B) accumulates an excessive refrigerant in the refrigerant circuit.

There are provided a first check valve 15-1, second check valve 15-2, third check valve 15-3, and fourth check valve 15-4. Each check valve makes a circulation path of the refrigerant that varies dependent on the cooling or heating operation fixed according to each operation and prevent the refrigerant to flow backward in the other paths. The first check valve 15-1 (15-1A and 15-1B) is located between the heat source side heat exchanger 13 and the second main pipe 200 to allow a refrigerant circulation only in the direction from the heat source side heat exchanger 13 to the second main pipe 200. The second check valve 15-2 (15-2A and 15-2B) is located between the four-way switching valve 12 and the first main pipe 100 to be mentioned later to allow a refrigerant circulation only in the direction from the first main pipe 100 to the four-way switching valve 12. The third check valve 15-3 (15-3A and 15-3B) is located between the four-way switching valve 12 and the second main pipe 200 to allow a refrigerant circulation only in the direction from the four-way switching valve 12 to the second main pipe 200. The fourth check valve 15-4 (15-4A and 15-4B) is located between the heat source apparatus side heat exchanger 13 and the first main pipe 100 to allow a refrigerant circulation only in the direction from the first main pipe 100 to the heat source apparatus side heat exchanger 13. A first manual opening and closing valve 16-1 (16-1A and 16-1B) and a second manual opening and closing valve 16-2 (16-2A and 16-2B) are in a closed state, for example, at the time of shipment. Then, they are opened at the installation and made to circulate the refrigerant. Therefore, when operating the sir conditioning apparatus 1, they are usually in the open state.

The relay 30 in the present embodiment is composed of a first branched part 31, second branched part 36, gas-liquid separator 41, and relay supercooled portion 42. The first branched part 31 has a first opening and closing valve 34 (34*a*, 34*b*, and 34*c*), second opening and closing valve 35 (35*a*, 35*b*, and 35*c*), and association parts 32 and 33.

One ends of the first opening and closing valve 34 and the second opening and closing valve 35 are connected with the first branched pipe 300 respectively. Then, the other end of the first opening and closing valve 34 is collectively connected by the association part 32 to connect with the first main pipe 100. Further, the other end of the second opening and closing valve 35 is collectively connected by the association part 33 to connect with the second main pipe 200 through the gas liquid separator 41. When flowing in the refrigerant from the indoor unit 20 to the first main pipe 100, the first opening and closing valve 34 is opened and the second opening and closing valve 35 is closed. When flowing in the refrigerant from the second main pipe 200 to the indoor unit 20 through the gas-liquid separator 41, the first opening and closing valve 34 is closed and the second opening and closing valve 35 is opened.

A second branched part 36 has a first relay check valve 39 (39*a*, 39*b*, and 39*c*), second relay check valve 40 (40*a*, 40*b*, and 40*c*), and association parts 37 and 38. The first relay check valve 39 and the second relay check valve 40 are in a reverse parallel relation and each end is connected with the second branched pipe, respectively. The other end of the first relay check valve 39 is collectively connected by the association part 37. In the same way, the other end of the second relay check valve 40 is collectively connected by the association part 38. When the refrigerant flows from the indoor unit 20 side to the relay supercooled portion 42 side, the flow passes the first relay check valve 39 and the association part 37. When the refrigerant flows from the relay supercooled portion 42 side to the indoor unit 20 side, the flow passes the second relay check valve 40 and the association part 38.

A gas-liquid separator 41 separates the refrigerant flowing from the second main pipe 200 into a gas refrigerant and a liquid refrigerant. A gas phase part (not shown) from which a gas refrigerant flows out is connected with the first branched part 31 (association part 33). When the second opening and closing valve 35 is open, the gas refrigerant flows into the indoor unit 20 side. On the other hand, the liquid phase part (not shown) from which the liquid refrigerant flows out is connected with the second branched part 36 through the relay supercooled portion 42.

The relay supercooled portion 42 has a first flow rate control device 43, bypass piping 44, second flow rate control device 45, second heat exchange part 46, and first heat exchange part 47. The relay supercooled portion 42 is provided in order to overcool the liquid refrigerant, for example, at the time of the cooling operation to supply it to the heat source apparatus 10. The refrigerant and the like used for overcooling is made to flow into the main pipe 100. The first flow rate control device 43 adjusts a refrigerant flow amount (a refrigerant amount flowing per unit time) flowing from the gas liquid separator 41 to the second branched part 36 through the first heat exchange part 47 and second heat exchange part 47. A bypass piping 47 connects the second branched part 36 with the main pipe 100 through the first heat exchange part 47 and the second heat exchange part 46. The second flow rate control device 45 adjusts the refrigerant flow amount passing through the bypass piping 44. The second heat exchange part 46 performs heat exchange between the refrigerant at the downstream part of the second flow rate control device 45 flowing through the bypass piping 44 and the refrigerant flowing from the first flow rate control device 43 to the association part 38 of the second branched part 36. On the other hand, the first heat exchange part 47 performs heat exchange between the refrigerant flowing at the downstream part of the bypass piping 44 and the second heat exchange part 46 and the refrigerant flowing from the gas-liquid separator 41 to the first flow rate control device 43.

A first pressure detector 60 and a second pressure detector 61 are attached to the relay 30. The first pressure detector 60 is attached to the piping which connects the first flow rate control device 43 and the gas-liquid separator 41. The second pressure detector 61 is attached to the piping which connects the first flow rate control device 43 and the second branched part 36.

Next, descriptions will be given to the configuration of the indoor unit 20 (20*a*, 20*b*, and 20*c*). The indoor unit 20 includes an indoor unit side heat exchanger 21 and an indoor unit side flow rate control device 22*a* adjacently connected in series with the indoor unit side heat exchanger 21. The indoor unit side heat exchanger 21 serves as an evaporator in the cooling operation and as a condenser in the heating operation like the above mentioned heat source apparatus side heat exchanger 13 to perform heat exchange between the air and the refrigerant in the air conditioning object space. The indoor unit side flow rate control device 22 functions as a pressure reducing valve and expansion valve to adjust the pressure of the refrigerant passing the indoor unit side heat exchanger 21. Here, the indoor unit side flow rate control device 22 according to the present embodiment is composed of an electronic expansion valve capable of changing an opening degree, for example. Then, at the time of the cooling operation, based on a degree of superheat at a refrigerant outlet side of the indoor unit side heat exchanger 21, an opening and closing status (opening degree) of the indoor unit side flow rate control device 22 is controlled. At the time of the heating operation, based on the degree of supercooling degree at the refrigerant outlet side (here, the second branched pipe 400), the opening and closing status (opening degree) of the indoor unit side flow rate control device 22 is controlled.

The air conditioning apparatus of the present embodiment that is configured as the above can perform operation of any of the four forms as mentioned the above: all cooling operation, all heating operation, cooling-dominant operation, and heating-dominant operation. Here, the heat source apparatus side heat exchanger 13 of the heat source apparatus 10 functions as a condenser at the time of the all cooling operation and cooling-dominant operation and functions as an evaporator at the time of the all heating operation and heating-dominant operation.

Next, descriptions will be given to the all cooling operation based on FIG. 1. Here, the case will be explained when all the indoor units 10 perform the cooling operation. The flow direction of the refrigerant at the all cooling operation is denoted by solid line arrows in FIG. 1. Here, descriptions will be given focusing on the heat source 10A. In the heat source apparatus 10A, the compressor 11A compresses a sucked refrigerant to discharge a high-pressure gas refrigerant. The refrigerant discharged from the compressor 11A flows into the heat source apparatus side heat exchanger 13A through the four-way switching valve 12A. The high-pressure gas refrigerant is condensed through heat exchange while passing through the heat source side heat exchanger 13A. Then, the high-pressure gas refrigerant turns into a high-pressure liquid refrigerant to flow through a first check valve 15-1A and second connection piping 600A (because of the pressure of the refrigerant, it does not flow into a third check valve 15-3A and fourth check valve 15-4A side). On the other hand, in the heat source apparatus 10B, the refrigerant flows through the second connection piping 600B in the same way. The high-pressure liquid refrigerant flowed through the second connection piping 600A and second connection piping 600B merges in a merger 51 to flow into the relay 30 through by way of the second main pipe 200.

A gas liquid separator 41 separates the refrigerant flowing into the relay 30 into a gas refrigerant and a liquid refrigerant. Here, in the all cooling operation, the refrigerant flowing into the relay 30 is the liquid refrigerant, almost no gas refrigerant basically. At the time of the heating operation, in the first branched part 31, the first opening and closing valve 34 (34*a*, 34*b*, and 34*c*) is opened and the second opening and closing valve 35 (35*a*, 35*b*, and 35*c*) is closed. Therefore, no gas refrigerant flows in the indoor unit 20 (20*a*, 20*b*, and 20*c*) side. On the other hand, the liquid refrigerant passes through the second heat exchange part 46 and first flow rate control device 43 and part of it flows into the second branched part 36. The refrigerant flowed into the second branched part 36 branched into the indoor units 20*a*, 20*b*, and 20*c* through an association part 37, first relay check valves 39*a*, 39*b*, and 39*c*, and second branched pipes 400*a*, 400*b*, and 400*c*.

In the indoor units 20*a*, 20*b*, and 20*c*, the liquid refrigerant flowing from the second branched pipes 400*a*, 400*b*, and 400*c* are subjected to an opening adjustment by the indoor unit side flow rate control devices 22*a*, 22*b*, and 22*c* to be pressure-adjusted. Here, as mentioned before, the opening adjustment by the indoor unit side flow rate control devices 22 is performed based on the degree of superheat of each indoor unit side heat exchanger 21 at the refrigerant outlet side. Through the opening adjustment of each indoor unit side flow rate control device 22*a*, 22*b*, and 22*c*, the refrigerant turned into a low-pressure gas-liquid two-phase refrigerant or low-pressure liquid refrigerant flows into the indoor unit side heat exchangers 21*a*, 21*b*, and 21*c*, respectively. The low-pressure gas-liquid two-phase refrigerant or low-pressure liquid refrigerant evaporates through the heat exchange between the indoor air to be an air conditioning object space while passing through the indoor unit side heat exchangers 21*a*, 21*b*, and 21*c*, respectively. Then, it turns into a low-pressure gas refrigerant to flow into the first branched pipes 300*a*, 300*b*, and 300*c*, respectively. Thereby, it cools the indoor air through the heat exchange to perform the cooling operation in the room. Here, the gas refrigerant is employed, however, in some cases, it may not be completely gasified in the indoor unit side heat exchangers 21*a*, 21*b*, and 21*c* and gas-liquid two-phase refrigerant flows, for example, when the air conditioning load (heat amount required by the indoor unit, hereinafter, referred to as a load) in each indoor unit 20 is small and when a transient operation is performed. The low-pressure gas refrigerant or gas-liquid two-phase refrigerant (low-pressure refrigerant) flowing from the first branched pipes 300*a*, 300*b*, and 300*c* flow into the first main pipe 100 through first opening and closing valves 34*a*, 34*b*, and 34*c* and association part 32.

A distributor 50 divides the low-pressure refrigerant flowing in the first main pipe 100 into the refrigerant to flow into the heat source apparatus 10A side and the refrigerant to flow into the heat source apparatus 10B side. The refrigerant to flow into the heat source apparatus 10A side flows into the heat source apparatus 10A through the first connection piping 500A. Then, the refrigerant circulates by returning to the compressor 11A again through the second check valve 15-2A, four-way switching valve 12A, and accumulator 14A. The refrigerant to flow into the heat source apparatus 10B flows into the heat source apparatus 10B side through the first connection piping 500B as well. Then, the refrigerant returns back to the compressor 11B through the second check valve 15-2B, four-way switching valve 12B, and accumulator 14B of the heat source apparatus 10B. This is a circulation path of the refrigerant at the time of the all, cooling operation.

Here, descriptions will be given to the refrigerant flow in the relay supercooled portion 42. As mentioned before, the liquid refrigerant divided by the gas-liquid separator partly flows into the second branched part 36 by way of the second heat exchange part 46 and the first flow rate control device 43. On the other hand, the refrigerant which does not flow into the second branched part 36 side passes through the bypass piping 14. Then, by adjusting the opening of the second flow rate control device 45, the refrigerant passes through the second heat exchange part 46 and the first heat exchange part 47 to supercool the refrigerant flowing into the second branched part 36 and flow into the first main pipe 100 as a low-pressure refrigerant. By supercooling the refrigerant, it is possible to reduce a enthalpy at the refrigerant inlet side (here, the second branched pipe 400 side) and increase the heat exchange amount with the air in the indoor unit side heat exchangers 21*a*, 21*b*, and 21*c*. Here, when the opening of the second flow rate control device 45 becomes large to increase the refrigerant amount (the refrigerant used for supercooling) flowing through the bypass piping 14, some refrigerant cannot be evaporated. In such a case, the gas-liquid two-phase refrigerant flows into the distributor 50 through the first main pipe 100. In addition, the above holds not only for the configuration of the air conditioning apparatus 1 of the present embodiment. The same situations occur in the air conditioning apparatus having a configuration such that a circuit bypassing a high-pressure liquid refrigerant with a low-pressure side is externally provided to a plurality of heat source apparatuses and a bypassed flow flows into the inlet side of the distribution part (the distributor 20 in the present embodiment) for example.

Figure 2:
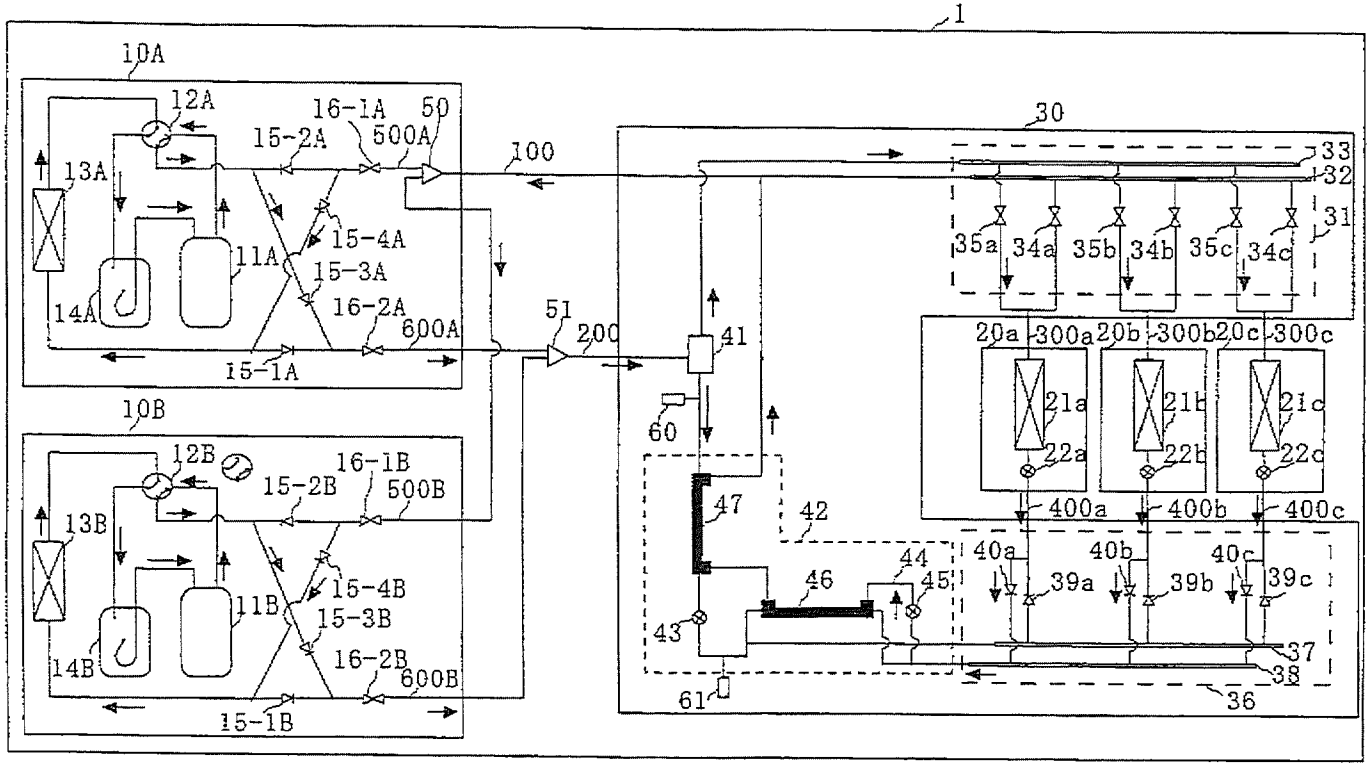
FIG. 2 is a diagram showing a refrigerant flow at an all heating operation according to Embodiment 1.

FIG. 2 diagram showing a refrigerant flow at the time of the all heating operation according to Embodiment 1. Here, descriptions will be given to a case in which all indoor units 20*a*, 20*b*, and 20*c* perform the heating operation. The refrigerant flow in the all heating operation is denoted by solid line arrows in FIG. 2. Here, the heat source apparatus 10A is mainly explained as well. In the heat source apparatus 10A, the refrigerant sucked by the compressor 11A is compressed and a high-pressure gas refrigerant is discharged. The refrigerant discharged from the compressor 11A flows into the second connection piping 600A through the four-way switching valve 12A and check valve 15-3A (the refrigerant does not flow in the check valves 15-2A and 15-1A side because of the refrigerant pressure). In the heat source apparatus 10B, the refrigerant flows in the second connection piping 600B based on the similar flow. The refrigerant flowing in the second connection piping 600A and 600B are merged by the merger 51 to flow into the relay 30 through the second main pipe 200.

The gas-liquid separator 41 separates the refrigerant flowed into the relay 30 into a gas refrigerant and a liquid refrigerant. The gas refrigerant flowed into the relay 30 flows into the relay 30 flows into the first branched part 31. Here, in the first branched part 31, the first opening and closing valve 34 (34*a*, 34*b*, and 34*c*) is closed and second opening and closing valve 35 (35*a*, 35*b*, and 35*c*) is opened. Therefore, the refrigerant flowed into the first branched part 31 is branched to all indoor units 20*a*, 20*b*, and 20*c* through the association part 33, second opening and closing valves 35*a*, 35*b*, and 35*c*, and first branched pipes 300*a*, 300*b*, and 300*c*.

In the indoor units 20*a*, 20*b*, and 20*c*, indoor unit side flow rate control devices 22*a*, 22*b*, and 22*c* adjust opening degree, respectively. Thus, regarding the refrigerant flowing from the first branched pipes 300*a*, 300*b*, and 300*c*, the pressure of the refrigerant flowing in the indoor unit side heat exchangers 21*a*, 21*b*, and 21*c* is adjusted, respectively. The high-pressure gas refrigerant is condensed through the heat exchange to turn into a liquid refrigerant while passing through the indoor unit side heat exchangers 21*a*, 21*b*, and 21*c* to pass through the indoor unit side flow rate control devices 22*a*, 22*b*, and 22*c*. Then, the indoor air is heated through the heat exchange and heating operation is performed in the room. The refrigerant passing through the indoor unit side flow rate control devices 22*a*, 22*b*, and 22*c* turns into a low-pressure gas-liquid two-phase refrigerant or low-pressure liquid refrigerant to flow into the association part 38 through the second branched pipes 400*a*, 400*b*, and 400*c* and second relay check valves 40*a*, 40*b*, and 40*c*. Then, the refrigerant passes through the second heat exchange section 46 and first heat exchange part 46 to flow into the first main pipe 100. Then, by adjusting the opening of the second flow rate control device 45, the low-pressure gas-liquid two-phase refrigerant flows into the first main pipe 100.

The distributor 20 divides the low-pressure refrigerant flowing in the first main pipe 100 into the refrigerant to flow into the heat source apparatus 10A side and the refrigerant to flow into the heat source apparatus 10B side. The refrigerant flowing at the heat source apparatus 10A side flows into the heat source apparatus 10A through the first connection piping 500A and passes through the fourth check valve 15-4A of the heat source apparatus 10A to flow into the heat source apparatus side heat exchanger 13A. While passing the heat source apparatus side heat exchanger 13A, the refrigerant evaporates to become a gas refrigerant through the heat exchange with the air. Then, the refrigerant returns to the compressor 11A again through the four-way switching valve 12A and accumulator 14A to circulate by being discharged as described before. The same is true for the refrigerant flowing into the heat source apparatus 10B side. The above is a circulation path of the refrigerant at the time of the all cooling operation.

Here, descriptions are given provided that in the above-mentioned all cooling operation and all heating operation, all indoor units 20*a*, 20*b*, and 20*c* perform operation, however, for example, part of the indoor units may perform or stop operation. When part of the indoor units 20 stops and the load is small for the entire air conditioning apparatus, either the compressor 11A or 11B of the heat source apparatuses 10A and 10B may be stopped.

Figure 3:
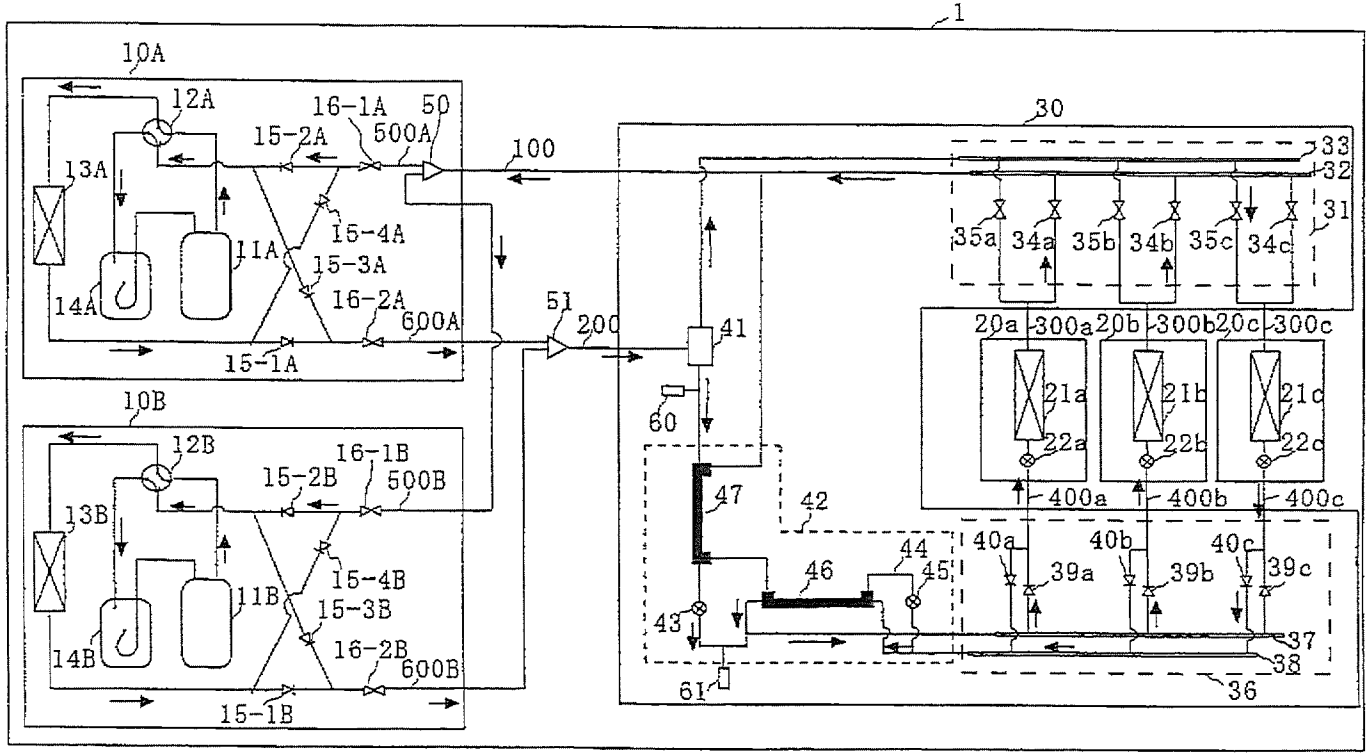
FIG. 3 is a diagram showing a refrigerant flow at a cooling-dominant operation according to Embodiment 1.

FIG. 3 is a diagram showing a refrigerant flow at the time of the cooling-dominant operation according to Embodiment 1. Here, descriptions will be given to a case when the indoor units 20*a* and 20*b* perform the cooling operation and the indoor unit 20*c* performs the heating operation. The refrigerant flow in the cooling-dominant operation is denoted by solid line arrows in FIG. 3. Descriptions will be omitted for the operations performed by the heat source apparatuses 10A and 10B and refrigerant flow because they are the same as the all cooling operation explained using FIG. 1. However, here, by controlling the condensation of the refrigerant in the heat source apparatus side heat exchangers 13A and 13B, the refrigerant flowing into the relay 30 through the second main pipe 200 is made to be a gas-liquid two-phase refrigerant.

Descriptions will be omitted for the refrigerant flow in the cooling operation by the indoor units 20*a* and 20*b* because they are the same as the flow in the all cooling operation explained using FIG. 1. Here, the indoor unit 20*c* performs the heating operation and the refrigerant flow is different from that of the indoor units 20*a* and 20*b* in the cooling operation, therefore, the refrigerant flow is mainly explained. Firstly, the gas-liquid separator 41 divides the refrigerant flowed into the relay 30 into a gas refrigerant and a liquid refrigerant. Since in the first branched part 31, the first opening and closing valves

34*a* and 34*b* are open and the second opening and closing valves 35*a* and 35*b* are closed, the gas refrigerant does not flow into the indoor units 20*a* and 20*b* sides. On the other hand, since the first opening and closing valves 34*c* is closed and the second opening and closing valves 35*c* is opened, the gas refrigerant flows into the indoor unit 20*c* side through the association part 33, second opening and closing valve 35*c*, and first branched pipe 300*c*.

In the indoor unit 20*c*, the indoor unit side flow rate control device 22*c* adjusts the opening and regarding the refrigerant flowing from the first branched pipe 300*c*, pressure adjustment is performed for the refrigerant flowing in the indoor unit side heat exchanger 21*c*. Then, the high-pressure gas refrigerant is condensed into a liquid refrigerant while passing in the indoor unit side heat exchanger 21*c* to pass through the indoor unit side flow rate control device 22*c*. Thereby, the indoor air is heated through the heat exchange and heating operation is performed in the room. The liquid refrigerant passing the indoor unit side flow rate control device 22*c* turns into a low-pressure liquid refrigerant to flow into the association part 38 through the second branched pipe 400*c* and second relay check valve 40*c*. Thereafter, the refrigerant passes a branched part to the first flow rate control device 15 and through the second heat exchanger part 46 to merge with the refrigerant at a downstream that flows from the gas liquid separator 41 and passes the second flow rate control device 13. Then, the refrigerant flows into the indoor units 20*a* and 20*b* to turn into the refrigerant for the cooling operation.

As mentioned above, in the cooling-dominant operation, the heat source apparatus side heat exchanger 13A of the heat source apparatus 10A and the heat source apparatus side heat exchanger 13B of the heat source apparatus 10B become condensers. The refrigerant passing through the indoor unit 20 (here, the indoor unit 20*c*) in the heating operation is used for the refrigerant for the indoor unit 20 (here, the indoor units 20*a* and 20*b*) in the cooling operation. However, the loads in the indoor units 20*a* and 20*b* are small, so that when the refrigerant flowing in the indoor units 20*a* and 20*b* is suppressed, the opening of the first flow rate control device 15 is increased. Thus, the refrigerant passing through the indoor unit 20*c* to flow into the association part 38 can be made to pass through the second heat exchange part 46 and the first heat exchange part 47 and bypassed to flow into the first main pipe 100. Then, through the first main pipe 100, a gas-liquid two-phase refrigerant flows into the distributor 50.

Figure 4:
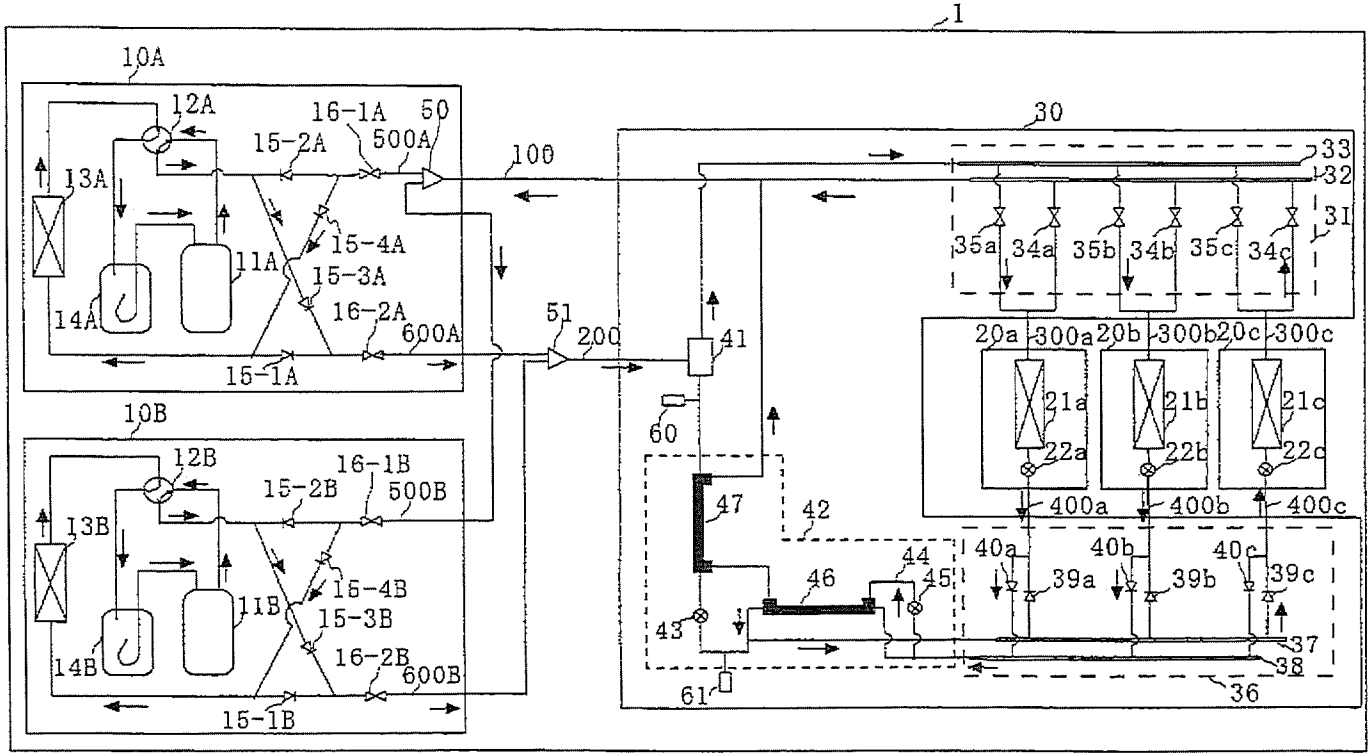
FIG. 4 is a diagram showing a refrigerant flow at a heating-dominant operation according to Embodiment 1.

FIG. 4 is a diagram showing the refrigerant flow at the heating-dominant operation according to Embodiment 1. Here, descriptions will be given to a case when the indoor units 20*a* and 20*b* perform the heating operation and the indoor unit 20*c* performs the cooling operation. The refrigerant flow in the cooling-dominant operation is denoted by solid line arrows in FIG. 4. Descriptions will be omitted for the operations performed by the heat source apparatuses 10A and 10B and the refrigerant flow because they are the same as the all heating operation explained using FIG. 2.

Descriptions will be omitted for the refrigerant flow in the heating operation by the indoor units 20*a* and 20*b* because they are the same as the flow in the all heating operation explained using FIG. 2. Here, the indoor unit 20*c* performs the cooling operation and refrigerant flow is different from that of the indoor units 20*a* and 20*b* in the heating operation, therefore, the refrigerant flow is mainly explained. In the indoor units 20*a* and 20*b*, the refrigerant is condensed to turn into a liquid refrigerant through the heat exchange while passing through the indoor unit side heat exchangers 21*a* and 21*b* to pass through the association part 38 through the indoor unit side flow rate control devices 22*a* and 22*b*. Then, the first flow rate control device 43 is made to be closed state by the opening adjustment. Therefore, the refrigerant flow is suspended from the gas-liquid separator 41 and no refrigerant flows in the gas-liquid separator 41. Therefore, the refrigerant passing through the association part 18A flows into the indoor unit 20*c* through the association part 37, the first relay check valve 39*c*, and the second branched pipe 400*c* by way of the second heat exchange part 46 to become a refrigerant for the cooling operation.

In the heating-dominant operation, the refrigerant output from the indoor unit (here, the indoor units 20*a* and 20*b*) in the heating operation flows in the indoor unit (here, the indoor units 20 *c*) in the cooling operation. Therefore, when the indoor unit in the cooling operation stops, the amount of the gas-liquid two-phase refrigerant increases flowing in the bypass piping 44. To the contrary, when the load increases in the indoor unit in the cooling operation, the amount of the gas-liquid two-phase refrigerant flowing in the bypass piping 44 decreases. Therefore, while the refrigerant amount remains the same necessary for the indoor unit 20 in the heating operation, the heat exchange processing capability changes of the indoor unit heat exchanger 21 (evaporator) in the indoor unit 20 in the cooling operation. Then, capacities of the compressors 11A and 11B of the heat source apparatuses 10A and 10B become the same.

A discharged refrigerant flow amount (mass flow mount) and sucked refrigerant flow amount (mass flow mount) from each compressor 10 is the same. Therefore, when the load of the indoor unit 20 in the cooling operation under the heating-dominant operation changes, a dryness (density) of the low-pressure side refrigerant changes to keep a constant mass flow, that is a gas-liquid two-phase refrigerant flowing into the first main pipe 100 by way of the second flow rate control device 45. So that, the statuses of the refrigerant entering the distributor 50 varies from a high dryness state to a low dryness state even if it is a gas-liquid two-phase refrigerant. In any condition, since compressors 11A and 11B continue to perform driving, the refrigerant needs to be branched in the distributor 50.

Figure 5:
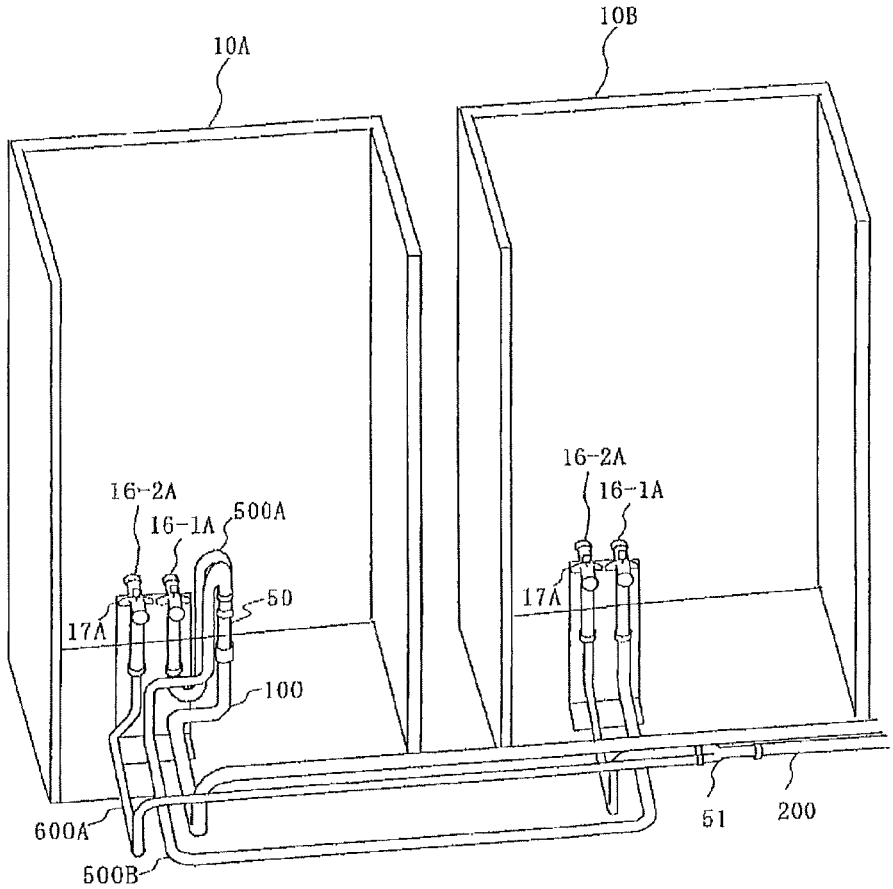
FIG. 5 is a diagram showing an installation status (arrangement) of means focusing on a distributor 50.

FIG. 5 is a diagram showing an installation status (arrangement) of means focusing on the distributor 50 in Embodiment 1. Here, descriptions will be given provided that the downward (in an actual installation, the ground (the bottom face of the heat source apparatus 10) side) in FIG. 5 is bottom and upside is up. FIG. 5 shows first manual opening and closing valves 16-1A and 16-1B, second manual opening and closing valves 16-2A and 16-2B, first main pipe 100, first connection piping 500A and 500B, distributor 50, second main pipe 200, merger 51, and second connection piping 600A and 600B in the above-mentioned heat source apparatus 10A and 10B. Regarding the heat source apparatus 10A and 10B, part of the chassis is shown. Besides the above means, fixing sheet metals 17 (17A and 17B) are shown in FIG. 5 as well, having a face extending to almost upward perpendicular direction against the bottom of the heat source apparatus 10 and fixed. The fixing sheet metal 17A fixes the first manual opening and closing valve 16-1A and second manual opening and closing valve 16-2A at a predetermined position. In the same way, a fixing sheet metal 17B inside the heat source apparatus 10B fixes positions of the first manual opening and closing valve 16-1B and second manual opening and closing valve 16-2B.

Figure 6:
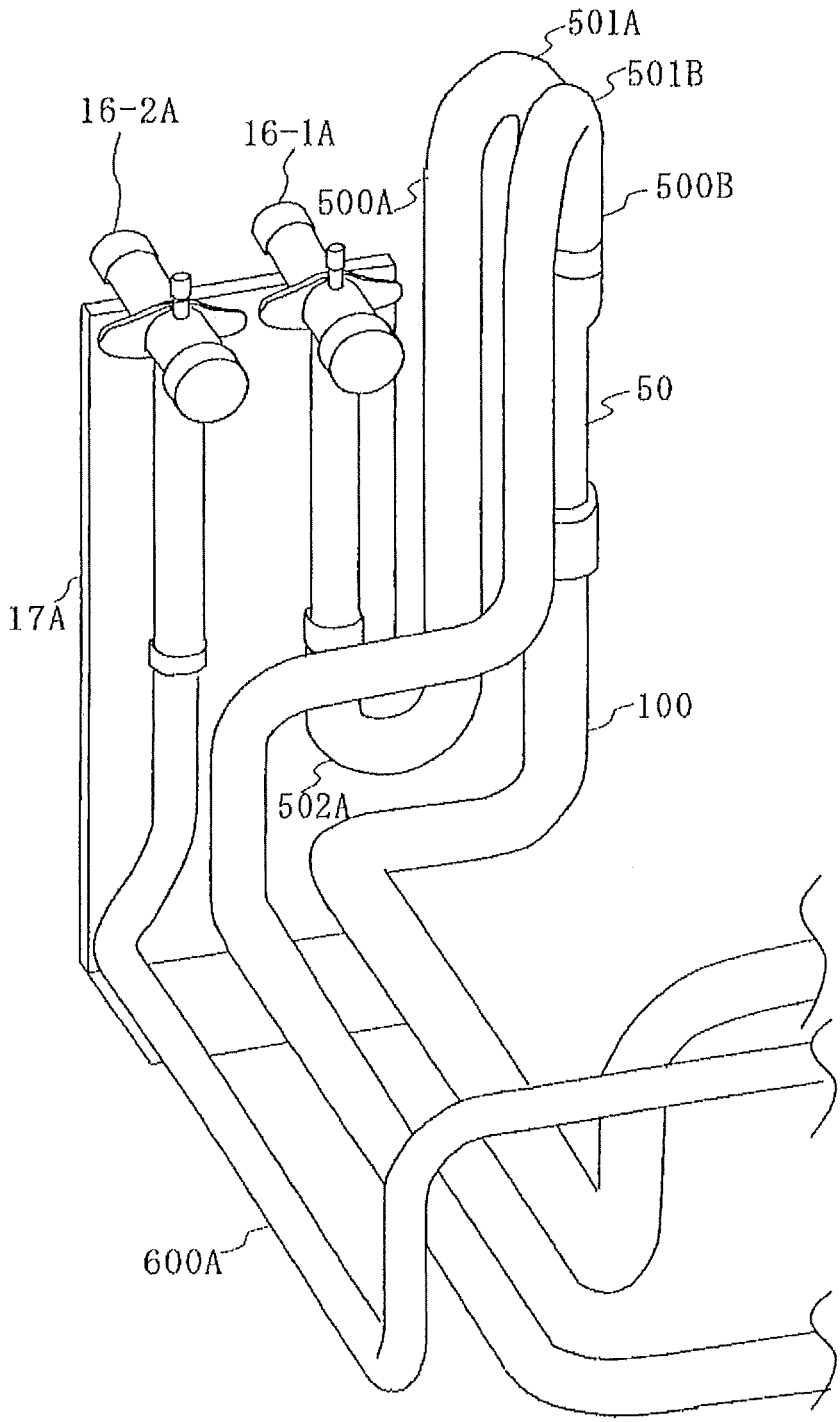
FIG. 6 is an enlarged diagram of FIG. 5 with the distributor 50 being the center.

FIG. 6 is an enlarged diagram of FIG. 5 with the distributor 50 being the center. As shown in FIG. 5, the distributor 50 is installed in the vicinity of the fixing sheet metal 17A inside the heat source apparatus 10A. Here, the shape of the first connection piping 500A connecting the distributor 50 with the first manual opening and closing valve 16-1A is specified in advance. Therefore, the manual opening and closing valve 16A in a fixed position in the heat source apparatus 10A and the first connection piping 500A whose shape is specified require an attachment position of the distributor 50 to be a fixed position (a specified position) by necessity. Further, regarding the distributor 50, the size of the piping diameter and length at the refrigerant inlet is specified in advance and fixed thereto. Therefore, it is possible to define a shape by the specified size upon assuming distribution of the refrigerant and the like.

As shown in FIG. 5, the distributor 50 is arranged in such a way that the refrigerant inlet is oriented almost vertically downside and the outlet for distributing the branched refrigerator is oriented almost vertically upside, the opposite direction. As a result, a bending part toward upward in the heat source apparatus 10A is formed for the first main pipe 100 to be connected with the inlet of the distributor 50. Since two outlets are located at the same position against the ground (regarding their heights, outlet directions), there will be no imbalance of the refrigerant in one outlet due to a gravity, so that the refrigerant can be distributed at a supposed predetermined distribution.

Two outlets of the distributor 50 and first connection piping 500A and 500B are connected respectively. Here, descriptions will be given to the shape of the first connection piping 500A. The first connection piping 500A of the present embodiment has a U-shaped bending part 501A for at one end part. In the case of an actual connection of the first connection piping 500A, the bending part 501A is made to be a reverse U-shaped and the first connection piping 500A is connected with the bending part 501A being the upper side than the inlet position of the distributor 50. The first connection piping 500B has the bending part 501B as well. Regarding at least the first connection piping 500A, the U-shaped bending part 502A is provided at the other end as well. The bending part 502A is connected so that it is made to be a lower side than the connection part with the first manual opening and closing valve 16-1A. By defining the shape of the first connection piping 500A in advance, it is possible to specify the piping length, position, and attachment direction to the manual opening and closing valve 16-1A (compressor 11A) to fixedly dispose the distributor 50 at a specified position.

Here, in the air conditioning apparatus 1 capable of performing a cooling-heating mixed, operation like the present embodiment, the first main pipe 100 serves as returning piping in which the refrigerant always returns from the indoor unit 20 to the heat source apparatus 10 side including the cooling-dominant operation and heating-dominant operation. Therefore, the refrigerant amount in the distributor 50 significantly changes in an order such that all cooling operation>cooling-dominant operation>heating-dominant operation, for example. Here, in the all cooling operation, a low-pressure gas or a high dryness gas refrigerant flows in the first main pipe 100. Then, since a refrigerant density is small, there is a tendency that the refrigerant flow becomes faster. The larger the refrigerant flow amount and the longer the piping length, slower the performance due to a friction loss. Therefore, in order to lower a pressure loss at the maximum refrigerant flow amount, a piping diameter of the main pipe 100 is made large to lower the flow rate of the refrigerant. That allows an inlet diameter in the distributor 50 to be large to lower the flow rate, as well. Here, a droplet (refrigerant, refrigerator oil) contained in the refrigerant is significantly subjected to the gravity when a gas flow rate is lowered. Especially, when there is a bending part in the piping, no homogeneous mass distribution is available in a cross section inside the piping due to a centrifugal force.

A specified position assuming the above is predetermined in the relation with the heat source apparatus 10A. In the air conditioning apparatus 1 having a plurality of the heat source apparatuses 10 like the heat source apparatuses 10A and 10B, specified members (the first connection piping 500A, in the present embodiment) for fixedly disposing the distributor 50 are prepared. Using the specified members, the distributor 50 is fixedly disposed so that its mounting position including its orientation becomes always fixed against the heat source apparatus 10A independent of the installation location of the heat source apparatuses 10A and 10B.

Thereby, it is possible to distribute the refrigerant amount flowing from the distributor 50 to the heat source apparatus 10A side in accordance with a predetermined assumption. (That is, the refrigerant flowing in another heat source apparatus 10B side becomes stable.) Since distribution based on a predetermined assumption is possible, for example, in the heat source apparatuses 10A and 10B, even when a slight difference in the distribution should occur, a product specification can be made in response thereto at the product development stage. For example, it is possible to correspond in such a way that a difference is provided in the refrigerant flow amount of the compressors 11A and 11B to change a return ratio of the liquid refrigerant.

It is considered that in the air conditioning apparatus 1 capable of performing a cooling-heating mixed operation, for example, when performing the cooling-dominant and heating-dominant operations in what is called an intermediate stage such as spring and autumn, the refrigerant flow amount returning to the distributor 50 becomes small. Then, since in the indoor unit 20 in the cooling operation the load becomes small, the refrigerant does not completely evaporate and turns into a gas-liquid two-phase refrigerant to flow in the first main pipe 100. As mentioned the above, by fixedly disposing the distributor 50, for example, it is possible to uniformly distribute the liquid refrigerant, leading to a proper distribution effect of the refrigerant. Especially in the air conditioning apparatus 1 capable of performing a cooling-heating mixed operation, the cooling operation frequently occurs in the intermediate stage. As a result, problems related to liquid distribution in the distributor 50 easily to happen, however, the fixedly disposed distributor may contribute toward solving the problems.

In the present embodiment, compressors 11A and 11B are a capacity-variable inverter compressor. When at least either of them is a capacity-variable compressor 11, the refrigerant flow amount significantly varies among a plurality of compressors 11. Even in such a case, it is possible to determine a specified position for the distributor 50 by adopting measures for the difference in the refrigerant flow amount at the product development stage. Further, by fixedly disposing the distributor 50 at the specified position, variation conditions of the liquid refrigerant distribution in accordance with the change in the refrigerant flow amount in the both compressors 11 can be stabilized. For example, by changing the piping diameter of the first connection piping 500A and 500B after the distributor 50, the distribution amount can be varied. In addition, the shape (length, diameter, and number of bending) of the first connection piping 500A provided inside the heat source apparatus 10A can be different from that of the first connection piping 500B. Thus, assuming the distribution amount of the liquid along with the distributor 50 is facilitated.

In the above descriptions, all the indoor units 20A are made to perform the cooling or heating operation, however, in some cases, only part of the indoor units 20 perform operation, for example. In such a case, since the load of the indoor unit 20 side is often small, all the heat source apparatuses 10 need not to be driven (the compressor 11 is driven), and sometimes part of them can be stopped. Therefore, it is considered that the heat source apparatus 10A (compressor 11A) is in operation and the heat source apparatus 10B (compressor 11B) is stopped. Basically, in many cases the load in the indoor unit 10 is small, there is a strong possibility that the refrigerant flowing through the main pipe 100 into the distributor 50 is a gas-liquid two-phase refrigerant. As mentioned the above, the liquid (liquid refrigerant) becomes a stratified flow flowing along the internal face of the piping to be subjected to gravity and centrifugal forces.

Typically, since the compressor 11B is stopped and no pressure related suction is generated at the first connection piping 500B side, no gas refrigerant flows. Here, in the air conditioning apparatus 1 according to the present embodiment, the distributor 50 is fixedly disposed so that the inlet is located at the lower side of the outlet. Accordingly, the liquid refrigerant turns into a stratified flow to flow along the internal face of the piping from downward to upward. The liquid refrigerant is heavier than the gas refrigerant, it has momentum. Therefore, there is a possibility that even if no gas refrigerant flows, the liquid refrigerant may try to flow into the first connection piping 500B side.

As mentioned the above, the first connection piping 500B according to the present embodiment extends further upward from the distributor 50, as mentioned before, to have a bending part 501B. As a result, the liquid refrigerant that tried to flow in the first connection piping 500B side is subjected to gravity, and rapidly stalls, falls downward to return back to the distributor 50. Therefore, it is possible to prevent the refrigerant to be supplied with the indoor unit 20 side from not returning back to the compressor 11 by that no refrigerant flows in the first connection piping 500B side. In addition, the first connection piping 500A also has a bending part 501A, however, since a force related to suction of the compressor 11A is exerted, the liquid refrigerant flows into the first connection piping 500A.

That holds to a case in which not only the liquid refrigerant but also the refrigerator oil flowed out of the compressor 11 returns back through each refrigerant piping, indoor unit 20, and the like. Therefore, no refrigerator oil flows toward the first connection piping 500B of the heat source apparatus 10 side that is not in operation, so that the compressor 11A in operation no longer becomes an oil-depleted state.

In the first main pipe 100, the refrigerant always flows in the direction from the indoor unit 20 side to the heat source apparatus 10 side. Therefore, when the refrigerant flow amount is small, especially the refrigerator oil cannot reach the distributor 50 while being carried by the flow, so that it is feared that the refrigerant may be accumulated before the distributor 50. An internal flow in the main pipe 100 will not be reversed, that is no refrigerant flows from the heat source apparatuses 10A and 10B side to the indoor unit 20 side. As a result, there is a possibility that the accumulated oil may continue to stay by the time when the refrigerant flow amount becomes larger. As for a method to return the accumulated oil, there is a method such that by deliberately increasing the refrigerant flow amount, the refrigerator oil is pushed out to pass the distributor 50, for example. Another method is that the liquid refrigerant having a low viscosity is made to flow from the indoor unit 20 side intentionally, and by dissolving the refrigerator oil into the liquid refrigerant to lower the viscosity, it becomes easier for the refrigerant oil to advance in the distributor 50. In any case, the droplet has to be separated upon reaching the distributor 50. By fixedly disposing the distributor 50 at a specified position, its posture can be fixed according to a predetermined manner. It is possible to keep the refrigerant flow amount for returning the refrigerator oil and liquid refrigerant amount to be returned at a minimum amount as assumed. Therefore, a stable air conditioning is possible without excessively changing the refrigeration cycle operation.

Embodiment 2

Figure 7:
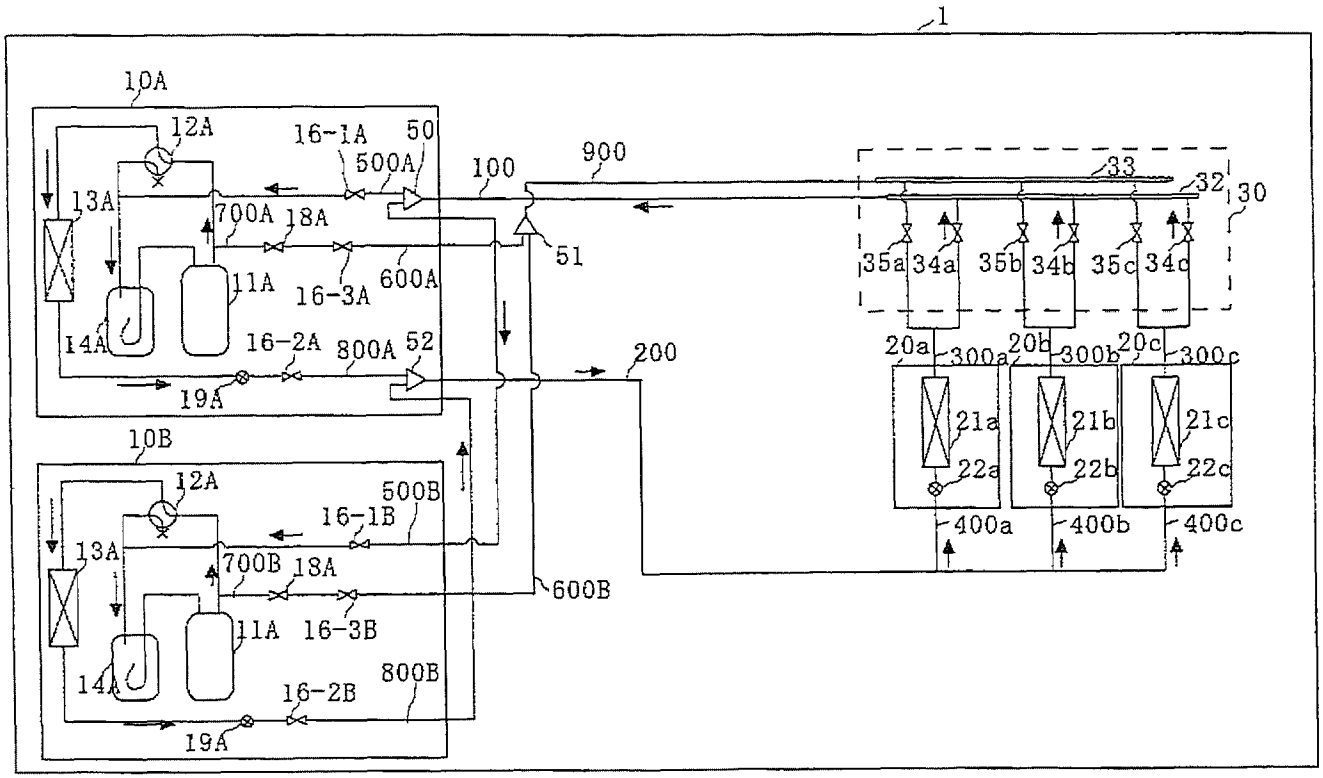
FIG. 7 is a diagram showing an entire configuration and the like of an air conditioning apparatus 1 according to Embodiment 2.

FIG. 7 is a diagram showing an entire configuration of the air conditioning apparatus according to Embodiment 2. In FIG. 7, descriptions will be omitted for those having the same numerals and symbols as in FIG. 1, because their operations will be the same as what is described in Embodiment 1. Here, the heat source apparatuses 10 (10A and 10B) according to Embodiment 2 has a branched pipe 700 (700A and 700B) being branched from a discharged side piping connecting the four-way switching valve 12 and the discharging side of the compressor 11. A third manual opening and closing valve 16-3 (16-3A and 16-3B) is provided on the branched pipe 700. Like the first manual opening and closing valve 16-1 and the second manual opening and closing valve 16-2, for example, the third manual opening and closing valve is closed when shipping and opened at the time of installation. An electromagnetic opening and closing valve 18 (18A and 18B) is located between the manual opening and closing valve 16-3 and the compressor 11 on the branched pipe 700. When the electromagnetic opening and closing valve 18 is open, the refrigerant passes through the branched pipe 700, and when closed, no refrigerant passes. A flow rate control valve 19 (19A and 19B) adjusts the refrigerant flow amount flowing between the heat source apparatus side heat exchanger 13 and the manual opening and closing valve 15.

A distribution merger 52 functions as a merger for merging the refrigerant like the merger 51 at the time of the all cooling operation and cooling-dominant operation when the heat source apparatus side heat exchanger 13 functions as a condenser. At the time of the all heating operation and heating-dominant operation when the heat source apparatus side heat exchanger 13A functions as an evaporator, the distribution merger 52 functions as a distributor for distributing the refrigerant like the distributor 50. Here, it is not limited in particular, although, since the distribution merger 52 functions as a distributor as well, its shape can be the same as that of the distributor 50 described in Embodiment 1. The distribution merger 52 can be provided in the heat source apparatus 10A like the distributor 50. Here, it is provided in the heat source apparatus 10A. Therefore, a third connection piping 800A is provided in the heat source apparatus 10A as well. Its shape is predetermined like the first connection piping 500A. Thereby, the installation position of the distribution merger 52 in the heat source apparatus 10A is a fixed position (provision). On the other hand, the third connection piping 800B is connected to the manual opening and closing valve 15B inside the heat source apparatus 10B again after going out the heat source apparatus 10A once in order to connect to the distribution merger 52 in the heat source apparatus 10A.

A main high-pressure gas pipe 900 is connected to a branched pipe 700 (the manual opening and closing valve 16-3) through the merger 51 and the second connection piping 600 and the discharged gas refrigerant flows therein. In the present embodiment, the merger 51 is installed outside the heat source apparatuses 10A and 10B.

Next, descriptions will be given to the all cooling operation based on FIG. 7. Here, a case will be explained in which all the indoor units 20*a*, 20*b*, and 20*c* perform the cooling operation. The refrigerant flow in the all cooling operation is shown by solid line arrows in FIG. 7. Here, descriptions will be given focusing on the heat source apparatus 10A. In the heat source apparatus 10A, the compressor 11A compresses the sucked refrigerant to discharge a high-pressure gas refrigerant. The refrigerant discharged from the compressor 11A flows into the heat source apparatus side heat exchanger 13A through the four-way switching valve 12A. On the other hand, since the electromagnetic opening and closing valve 18A is closed at the time of the all cooling operation, no refrigerant flows in the main high-pressure gas pipe 900.

The high-pressure refrigerant flowing into the heat source apparatus side heat exchanger 13A is condensed through the heat exchange while passing the heat source apparatus side heat exchanger 13A and turns into a high-pressure liquid refrigerant to flow into the third connection piping 800A through the flow rate control valve 19A. On the other hand, in the heat source apparatus 10B, the refrigerant flows in the third connection piping 800B in accordance with a similar flow. The refrigerant passing the third connection piping 800A and third connection piping 800B merges in the distribution merger 52 to be branched into the indoor units 20*a*, 20*b*, and 20*c* by way of the second main pipe 200.

In the indoor units 20*a*, 20*b*, and 20*c*, the indoor unit side flow rate control devices 22*a*, 22*b*, and 22*c* adjust the pressure of the liquid refrigerant flowing from the second branched pipe 400*a*, 400*b*, and 400*c* by adjusting the opening, respectively. The opening adjustment of each indoor unit side flow rate control device 22 is performed based on a degree of superheat at a refrigerant outlet side of the indoor unit side heat exchanger 21. Through the opening adjustment by each indoor unit side flow rate control devices 22*a*, 22*b*, and 22*c*, the refrigerant turned into a low-pressure gas-liquid two-phase refrigerant or low-pressure liquid refrigerant flows into the indoor unit side heat exchangers 21*a*, 21*b*, and 21*c*, respectively. The low-pressure gas-liquid two-phase refrigerant or low-pressure liquid refrigerant evaporates through the heat exchange with the indoor air while passing the indoor unit side heat exchangers 21*a*, 21*b*, and 21*c* respectively to turn into a low-pressure gas refrigerant or gas-liquid two-phase refrigerant. Then, they flow into the first branched pipes 300*a*, 300*b*, and 300*c*, respectively. Then, it cools the indoor air through heat exchange to perform cooling operation in the room. At the time of the all cooling operation, all the first opening and closing valves are opened and all the second opening and closing valves 35 are closed in the first branched part 31. As a result, the low-pressure gas refrigerant or gas-liquid two-phase refrigerant (low-pressure refrigerant) flowing from the first branched pipes 300*a*, 300*b*, and 300*c* flows into the first main pipe 100 through the first opening and closing valves 34*a*, 34*b*, and 34*c* and the association part 32.

The distributor 50 divides the low-pressure refrigerant flowing in the main pipe 100 into the refrigerant flowing in the heat source apparatus 10A side and the refrigerant flowing in the heat source apparatus 10B side. The refrigerant flowing in the heat source apparatus 10A side circulates by flowing into the heat source apparatus 10A through the first connection piping 500A, passing the accumulator 14A of the heat source apparatus 10A, returning back to the compressor 11A, and being discharged as mentioned before. That makes a circulation path at the time of the cooling operation in a refrigerant main circuit. The refrigerant flowing into the heat source apparatus 10B flows into the heat source apparatus 10B through the first connection piping 500B to return back to the compressor 11B through the accumulator 14B of the heat source apparatus 10B in the same way.

Figure 8:
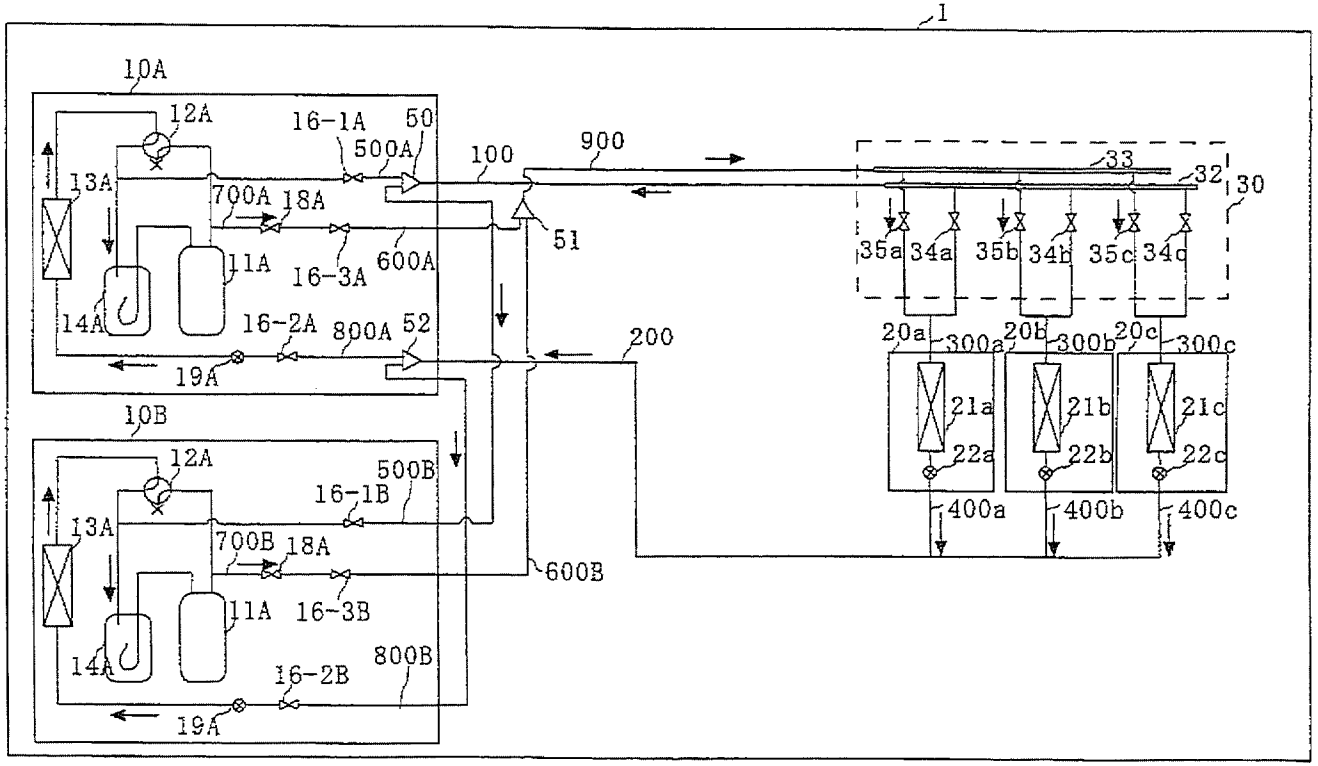
FIG. 8 is a diagram showing a refrigerant flow at an all heating operation according to Embodiment 2.

Next, descriptions will be given to the all heating operation based on FIG. 8. Here, a case will be explained in which all the indoor units 20*a*, 20*b*, and 20*c* perform the cooling operation. The refrigerant flow in the all cooling operation is shown by the solid line arrows in FIG. 8. Here, descriptions will be given focusing on the heat source apparatus 10A. Firstly, using the four-way switching valve 12A, switching is performed so as to connect the heat source apparatus side heat exchanger 13A and accumulator 14A. On the other hand, the valve is dosed for the refrigerant discharged from the compressor 11A not to pass the four-way switching valve 12A. The electromagnetic opening and closing valve 16A is opened for the refrigerant to flow into the main high-pressure gas pipe 900 through the branched pipe 700A, second connection piping 600A, and merger 51. Means corresponded by the heat source apparatus 10B is the same.

In the heat source apparatus 10A, the compressor 11A compresses the sucked refrigerant to discharge a high-pressure gas refrigerant. The discharged refrigerant from the compressor 11A flows into the second connection piping 600A through the branched pipe 700A and electromagnetic opening and closing valve 18A. In the heat source apparatus 10B, there is a refrigerant flow into the second connection piping 600B. The refrigerants flowing in the second connection piping 600A and the second connection piping 600B are merged by the merger 51 to flow into the first branched part 31 by way of the main high-pressure gas pipe 900. In the all heating operation, all the first opening and closing valves 34 are dosed and all the second opening and closing valves 35 are opened in the first branched part 31. The refrigerant flowing into the first branched part 31 is branched into the indoor units 20*a*, 20*b*, and 20*c* through the association part 33, the second opening and dosing valves 35*a*, 35*b*, and 35*c*, and the first branched pipes 300*a*, 300*b*, and 300*c*.

In the indoor units 20*a*, 20*b*, and 20*c*, indoor unit side flow rate control devices 22*a*, 22*b*, and 22*c* perform opening control, and for the refrigerants flowing from the first branched pipes 300*a*, 300*b*, and 300*c*, respectively, pressure is adjusted when flowing in the indoor unit side heat exchanger 21. The high-pressure gas refrigerant is condensed through the heat exchange while passing the indoor unit side heat exchangers 21*a*, 21*b*, and 21*c* and turns into a high-pressure liquid refrigerant to pass indoor unit side flow rate control devices 22*a*, 22*b*, and 22*c*. Thereby, indoor air is heated by heat exchange and heating operation is performed in the room. The refrigerant passing the indoor unit side flow rate control devices 22*a*, 22*b*, and 22*c* turns into a low-pressure gas-liquid two-phase refrigerant or low-pressure liquid refrigerant to flow into the second main pipe 200 through the second branched pipes 400*a*, 400*b*, and 400*c*.

The distribution merger 52 divides the low-pressure refrigerant flowing in the second main pipe 200 into the refrigerant to flow in the heat source apparatus WA side and the refrigerant to flow in the heat source apparatus 10B side. The refrigerant flowing in the heat source apparatus 10A side flows into the heat source apparatus 10A through the third connection piping 800A. Then, the refrigerant circulates by passing the heat source apparatus side heat exchanger 13A, four-way switching valve 12A, accumulator 14A, returning back to the compressor 11A, and being discharged as mentioned the above. That is a circulation path at the time of the heating operation. Here, since the heat source apparatus side heat exchanger 13A functions as an evaporator in the all heating operation, the refrigerant gasifies through heat exchange. The refrigerant flows in the heat source apparatus 10B flows into the heat source apparatus 10B through the third connection piping 800B in the same way. Then, the refrigerant returns back to the compressor 11B by way of the heat source apparatus side heat exchanger 13B, four-way switching valve 12B, and accumulator 14B of the heat source apparatus 10B of the heat source apparatus 10B.

Here, in the present embodiment, descriptions are given provided that in the all cooling operation and all heating operation described above, all indoor units A, B, and C are in operation, however, some indoor units may be in operation while others are stopped. For example, when some indoor units are stopped and the load is small for the entire air conditioning apparatus, either of the compressor 11A or 11B of the heat source apparatus 10A or 10B may be stopped.

Figure 9:
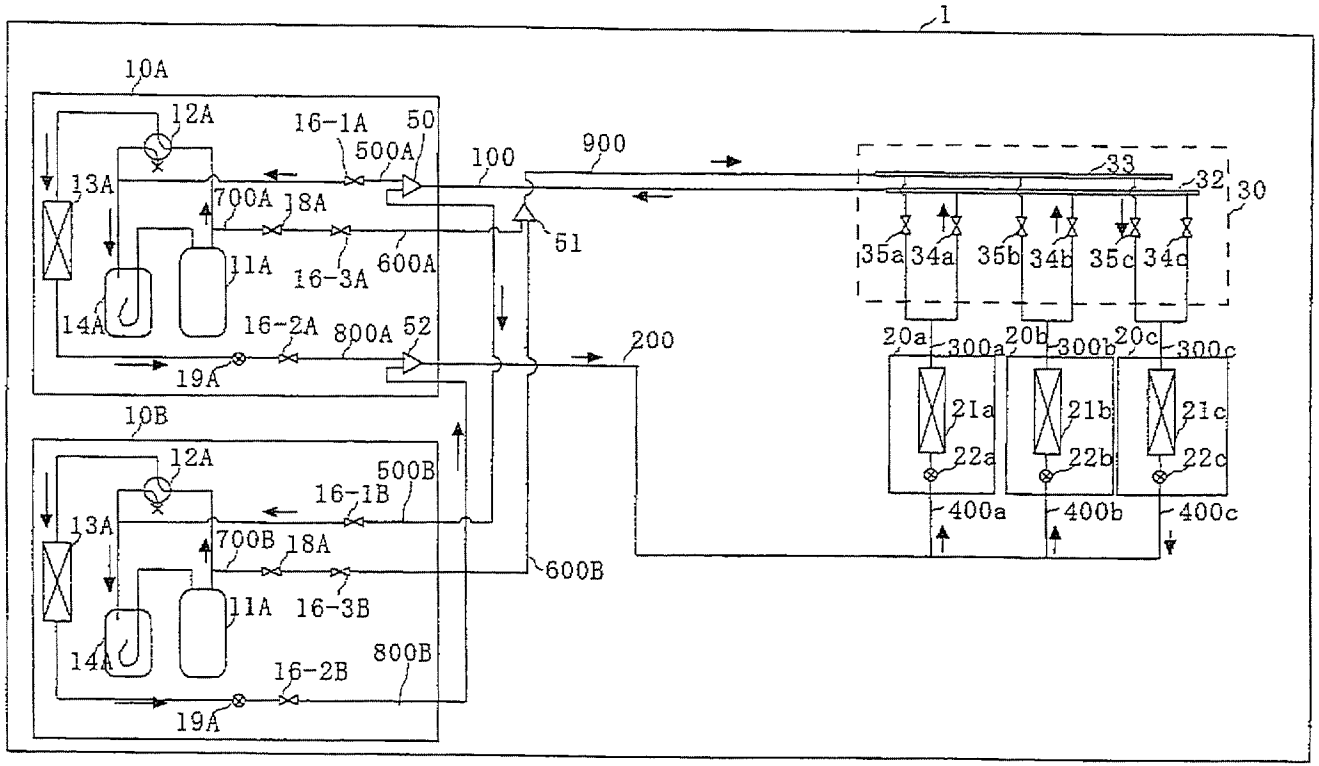
FIG. 9 is a diagram showing a refrigerant flow at a cooling-dominant operation according to Embodiment 2.

FIG. 9 is a diagram showing a refrigerant flow in the cooling-dominant operation according to Embodiment 2. Here, descriptions will be given to a case in which the indoor units 20*a* and 20*b* perform the cooling operation and the indoor unit 20*c* performs the heating operation. The refrigerant flow in the cooling-dominant operation is shown by the solid line arrows in FIG. 9. As for the operation performed by the heat source apparatuses 10A and 10B and refrigerant flow, descriptions will be omitted for the same part with the all cooling operation because explanations are the same as those using FIG. 7.

On the other hand, in the cooling-dominant operation, since unlike the all cooling operation, the gas refrigerant is supplied with the indoor unit (here, the indoor unit C) performing the heating operation, the electromagnetic opening and closing valve 18A is opened in the heat source apparatuses 10A. Thereby, part of the high-pressure gas refrigerant flows into the first branched part 31 through the branched pipe 700, second connection piping 600A, and merger 51. Here, when the load based on the heating operation is small, the electromagnetic opening and closing valve 18B of the heat source apparatuses 10B may be closed. On the other hand, when the load of the indoor unit 20 in the heating operation is large, the electromagnetic opening and closing valve 18B may be opened in the heat source apparatuses 10B as well and the high-pressure gas refrigerant may be supplied from the heat source apparatuses 10B side.

Descriptions will be omitted for the refrigerant flow in the indoor units 20*a* and 20*b* in the cooling operation because it is the same as those in the all cooling operation explained using FIG. 7, so that the heating operation of the indoor unit 20*c* will be explained. Here, in the first branched part 31, no gas refrigerant flows in the indoor units 20*a* and 20*b* side because the first opening and dosing valves 34*a* and 34*b* are opened and the second opening and dosing valves 35*a* and 35*b* are closed. On the other hand, since the first opening and closing valves 34*c* is closed and the second opening and closing valves 35*c* is opened, the gas refrigerant flows in the indoor unit 20*c* side through the association part 33A, second opening and closing valves 35*c*, and first branched pipe 300*c*.

In the indoor unit C, the indoor unit side flow rate control device 22*c* performs the opening adjustment and regarding the refrigerant flowing from the first branched pipe 300*c*, the pressure of the refrigerant is adjusted that flows in the indoor unit side heat exchanger 21*c*. Then, the high-pressure refrigerant is condensed and turns into a liquid refrigerant through heat exchange while passing the indoor unit side heat exchanger 21*c* to pass the indoor unit side flow rate control device 22*c*. Thereby, the indoor air is heated through heat exchange and the heating operation is performed in the room. The refrigerant passing the indoor unit side flow rate control device 22*c* turns into a little decompressed low-pressure refrigerant to pass the second branched pipe 400*c*. Then, the refrigerant merges with the refrigerant flowing in the second main pipe 200 and flows into the indoor units 20*a* and 20*b* to turn into a refrigerant for the cooling operation. As for the flow and operation of each means thereafter of the refrigerant for the cooling operation, descriptions will be omitted because they are the same as the flow of the all cooling operation explained using FIG. 7.

Figure 10:
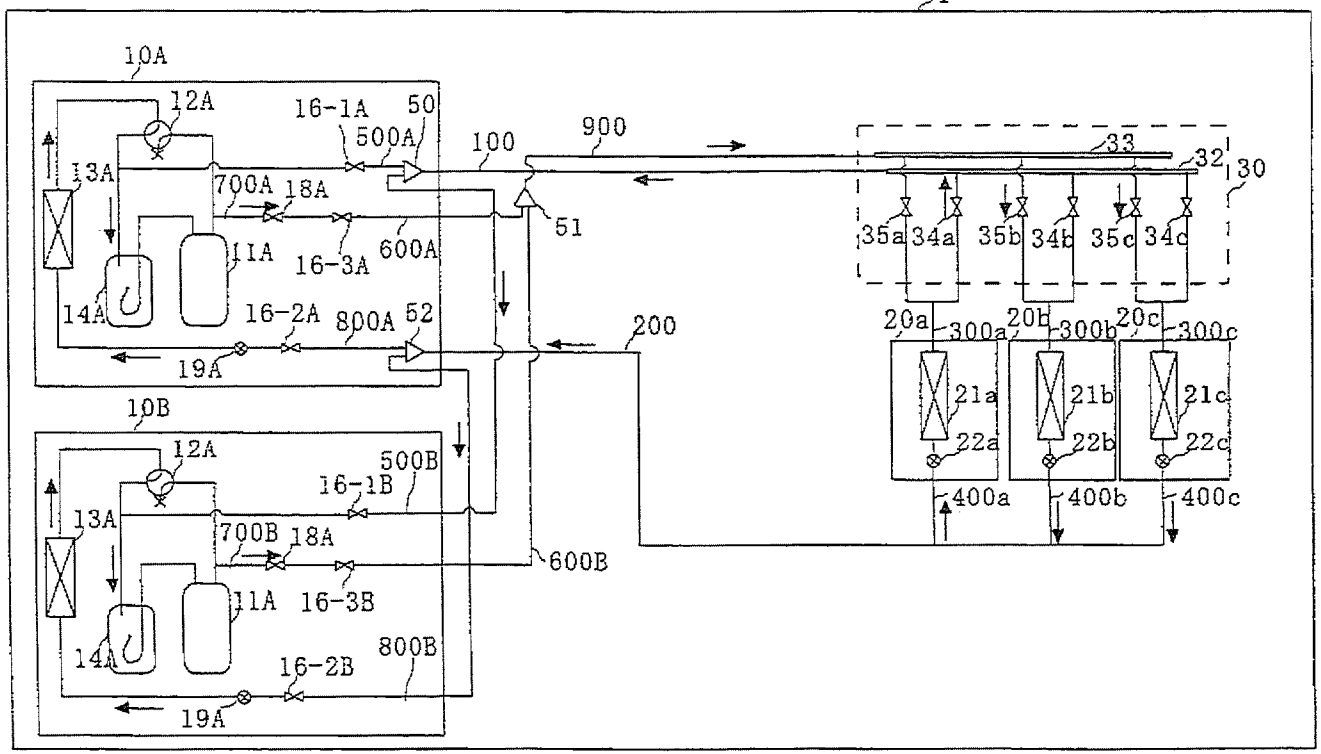
FIG. 10 is a diagram showing a refrigerant flow at a heating-dominant operation according to Embodiment 2.

FIG. 10 is a diagram showing a refrigerant flow in the heating-dominant operation according to Embodiment 2. Here, descriptions will be given to a case in which the indoor units 20*b* and 20*c* perform the heating operation and the indoor unit 20*a* performs the cooling operation. The refrigerant flow in the cooling-dominant operation is shown by the solid line arrows in FIG. 10. As for the operation performed by the heat source apparatuses 10A and 10B and refrigerant flow, descriptions will be omitted because explanations are the same as the all cooling operation explained using FIG. 8.

As for the refrigerant flow in the heating operation of the indoor units 20*b* and 20*c*, descriptions will be omitted because it is the same as the flow of the all heating operation. Here, the indoor unit 20*a* performs the cooling operation, and since the refrigerant flow is different from the indoor units 20*b* and 20*c* in the heating operation, descriptions will be given focusing the flow. In the indoor units B and C, the refrigerant is condensed into a liquid refrigerant through the heat exchange while passing the indoor unit side heat exchangers 21*a* and 21*b* to flow into the second branched pipes 400*b* and 400*c* through the indoor unit side flow rate control devices 22*a* and 22*b*.

Most of the refrigerant flowing in the second branched pipes 400*b* and 400*c* passes through the second main pipe 200 to flow into the heat source apparatuses 10A and 10B through the distribution merger 52. Part of the refrigerant flows into the indoor, unit A by way of the second branched pipe 400*a* to turn into a refrigerant for the cooling operation. Through the heat exchange of the indoor unit side heat exchanger 21*a* of the indoor unit A, the gasified gas refrigerant or gas-liquid two-phase refrigerant flows into the first main pipe 100 through the first branched pipe 300*a* and opening and closing valve 8*a*. The distributor 50 distributes a low-pressure refrigerant flowing in the first main pipe 100. Each divided refrigerant by the distribution flows into the heat source apparatus 10 to return back to the compressor 11 through the accumulator 14 of the heat source apparatuses 10.

Here, the distributor 50 and a joining branch part 25 are provided to connect to the first connection piping 500A and third connection piping 800 A whose shapes are provided in advance. Therefore, the same effect as Embodiment 1 can be obtained.

Embodiment 3

Figure 11:
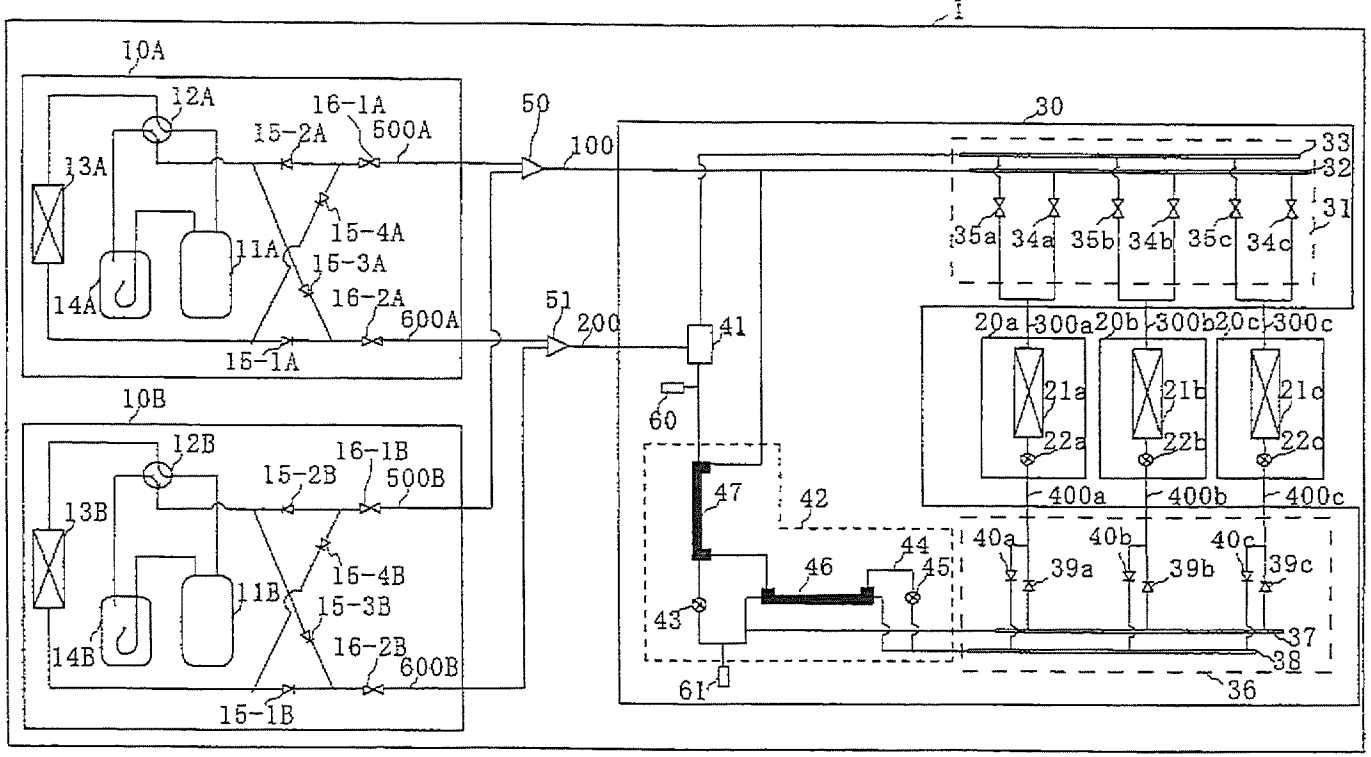
FIG. 11 is a diagram showing an entire configuration of the air conditioning apparatus 1 according to Embodiment 3.

FIG. 11 is a diagram showing an entire configuration of the air conditioning apparatus 1 according to Embodiment 3. FIG. 11 differs from FIG. 1 in that the distributor 50 is provided outside the heat source apparatus 1A. Like FIG. 11, as for a location where the distributor 50 or distribution merger 52 is installed, it is not limited to in the heat source apparatus 1A in particular. It can be fixed at a predetermined location outside the heat source apparatus 1A by the first connection piping 500A whose shape is provided in advance like Embodiment 1 as mentioned the above.

In Embodiment 1, the distributor 50 is fixedly disposed inside the heat source apparatus 10A by the first connection piping 500A, however, it is not limited thereto. For example, the distributor 50 may be fixedly disposed at the heat source apparatus 10B side. It goes without saying that when only the location where the distributor 50 is fixedly disposed is specified, the same effect can be observed by fixing it in the heat source apparatus 10A through a fixing sheet metal 17A and the like.

The distributor 50 can be fixedly built-in inside the heat source apparatus 10A in advance to be shipped into the market. Thereby; there is an advantage that an installation time can be reduced on the site. On the other hand, when not built-in, it is necessary to install it on the site. However, no distributor is required when a device is composed of only one heat source apparatus 10A, the heat source apparatus can be shared between a device having a plurality of heat source apparatuses and a device having a single heat source apparatus, so that an installation-flexible product can be obtained.

Embodiment 4

In the embodiment above, descriptions are given to the air conditioning apparatus 1 in which a heat source apparatus 10A and heat source apparatus 10B are provided, however, the number of the heat source apparatus is not limited to two. It goes without saying that in a device configuration having three or more heat source apparatuses 10, by fixing the distributor 50 at a predetermined location in part of the heat source apparatuses 10, an effect is the same on a refrigerant distribution to the heat source apparatus.

Like the embodiment above, the present invention has a main pipe in which the refrigerant flows in one direction from the indoor unit 20 to the heat source apparatus 10 side, so that it is effective for a device where the refrigerant flow amount changes, however, it is not limited thereto. For example, the present invention is applicable to other refrigeration cycle such as a refrigeration device.

The invention claimed is:

1. An air conditioning apparatus comprising:

a plurality of heat source apparatuses having a heat source apparatus side heat exchanger and a compressor, one or plurality of indoor units having a flow rate control device and an indoor unit side heat exchanger, at least two main pipes for pipe-connecting between said plurality of heat source apparatuses and one or plurality of indoor units, a tubular distributor for branching a refrigerant from said main pipe flowing from an inlet into a plurality of outlets to distribute into said plurality of heat source apparatuses, and connection piping for connecting said plurality of heat source apparatuses and said distributor respectively, wherein said distributor is fixedly disposed inside one heat source apparatus among said plurality of heat source apparatuses at a predetermined position and in a predetermined direction, said distributor being connected to said connection piping having a predetermined shape.

2. The air conditioning apparatus of claim 1, wherein said air conditioning apparatus is an air conditioning apparatus arranged to perform a cooling-heating mixed operation to circulate the refrigerant in said plurality of indoor units to simultaneously perform both the heating operation and cooling operation, and among said main pipes, the main pipe in which the refrigerant returns from said indoor unit to said heat source apparatus at the time of said cooling-heating mixed operation and said distributor are connected.

3. The air conditioning apparatus of claim 1, wherein said air conditioning apparatus is an air conditioning apparatus arranged to perform a cooling-heating mixed operation to circulate the refrigerant in said plurality of indoor units to simultaneously perform both the heating operation and cooling operation, and among said main pipes, the main pipe in which said refrigerant flows only in a direction where the refrigerant flows from said plurality of indoor units to said plurality of heat source apparatuses regardless of the cooling operation or heating operation and said distributor are connected.

4. The air conditioning apparatus of claim 1, wherein said connection piping has a configuration such that a U-shaped bending part is formed at a location higher than a connection part with said distributor.

5. The air conditioning apparatus of claim 1, wherein said distributor is fixedly disposed such that said inlet is at a ground side of said outlet.

6. The air conditioning apparatus of claim 1, wherein a piping diameter of said distributor at a refrigerant inlet side is fixed to a predetermined size.

7. The air conditioning apparatus of claim 1, wherein a piping length of said distributor at a refrigerant inlet side is fixed to a predetermined size.

8. The air conditioning apparatus of claim 1, wherein a refrigerant inlet of said distributor is disposed facing perpendicularly downward.

9. The air conditioning apparatus of claim 1, wherein a refrigerant outlet of said distributor is disposed facing perpendicularly upward.

10. The air conditioning apparatus of claim 1, wherein the refrigerant outlet of said distributor is disposed at the same location against the ground.

11. The air conditioning apparatus of claim 2, wherein said distributor is fixedly disposed such that said inlet is at a ground side of said outlet.

12. The air conditioning apparatus of claim 3, wherein said distributor is fixedly disposed such that said inlet is at a ground side of said outlet.

13. The air conditioning apparatus of claim 2, wherein a refrigerant inlet of said distributor is disposed facing perpendicularly downward.

14. The air conditioning apparatus of claim 3, wherein a refrigerant inlet of said distributor is disposed facing perpendicularly downward.

* * * * *